US009839289B1

(12) United States Patent
Stefan et al.

(10) Patent No.: US 9,839,289 B1
(45) Date of Patent: Dec. 12, 2017

(54) COMPARTMENT DIVIDER ASSEMBLY

(71) Applicants: Daniel Warren Stefan, Blue Jay, CA (US); Timothy Daniel Stefan, Blue Jay, CA (US)

(72) Inventors: Daniel Warren Stefan, Blue Jay, CA (US); Timothy Daniel Stefan, Blue Jay, CA (US)

(73) Assignee: SIZABLE ENTERPRISES INCORPORATED, Lake Arrowhead, CA (US)

( * ) Notice: Subject to any disclaimer, the term of this patent is extended or adjusted under 35 U.S.C. 154(b) by 0 days.

(21) Appl. No.: 15/379,021

(22) Filed: Dec. 14, 2016

(51) Int. Cl.
*A47F 5/00* (2006.01)
*A47B 88/00* (2017.01)
(Continued)

(52) U.S. Cl.
CPC ..... *A47B 88/975* (2017.01); *A47B 2088/976* (2017.01)

(58) Field of Classification Search
CPC . A47B 88/975; A47B 2088/976; A47B 57/58; A47B 57/581; A47B 57/583; A47B 57/585; A47B 57/586; A47B 57/588; A47B 65/10; A47B 65/15; A47B 65/00; A47B 96/04; A47B 88/20; A47B 2088/202; A47F 5/0035; A47F 5/132; A47F 7/144;
(Continued)

(56) References Cited

U.S. PATENT DOCUMENTS 2,985,333 A 2/1960 Eirkman
2,956,675 A 10/1960 Bates et al.
(Continued)

FOREIGN PATENT DOCUMENTS

EP 0893081 A2 1/1999
WO 2010085825 A1 8/2010
WO 2011048573 4/2011

OTHER PUBLICATIONS

Edwards, William D.; Adjustable Stop for the Miter Gauge; Article; Woodarchivist; Available at: http://woodarchivist.com/stop-block/.
(Continued)

*Primary Examiner* — Jennifer E. Novosad
(74) *Attorney, Agent, or Firm* — Hankin Patent Law, APC; Kevin Schraven; Lindsey Auerbach

(57) ABSTRACT

A compartment divider assembly. The compartment divider assembly may comprise: a first divider having at least one dovetail groove and a divider support groove assembly, comprising: a first groove portion having a first dovetail portion and a second groove portion, having a second dovetail portion. The first dovetail portion may have a planar face sloping outwardly at a dovetail angle. The second dovetail portion may also have a planar face sloping outwardly at a dovetail angle. The first dovetail portion and said second dovetail portion together may form a male dovetail when combined, and the male dovetail may engage and secure onto the dovetail groove of the first divider. The compartment divider assembly may further comprise a corner coupler, comprising: two male dovetails, both of which may be adapted to slideably engage with a dovetail groove. The compartment divider assembly may also comprise an accessory holder for receiving an accessory.

21 Claims, 38 Drawing Sheets

(51) Int. Cl.
*A47B 88/975* (2017.01)
*A47B 88/969* (2017.01)

(58) Field of Classification Search
CPC ..... Y10T 403/7094; Y10T 403/7018; Y10T 403/7064
USPC ..... 211/184, 10, 182, 183; 312/348.3; 403/381, 355, 374.1
See application file for complete search history.

(56) References Cited

U.S. PATENT DOCUMENTS

| | | | | |
|---|---|---|---|---|
| 3,498,685 | A | 3/1970 | Poplinski | |
| 3,552,817 | A * | 1/1971 | Marcolongo | A47B 87/02 312/107 |
| 3,703,326 | A | 11/1972 | Riviers | |
| 3,954,202 | A | 5/1976 | Petrick | |
| 4,025,215 | A | 5/1977 | Murdock et al. | |
| 4,488,653 | A | 12/1984 | Belokin | |
| 4,595,246 | A | 6/1986 | Bross | |
| 4,705,168 | A | 11/1987 | Ward | |
| 5,058,746 | A * | 10/1991 | Morgan, IV | B65D 19/18 206/597 |
| 5,143,132 | A | 9/1992 | Keller | |
| 5,154,299 | A | 10/1992 | Hwang | |
| 5,190,186 | A * | 3/1993 | Yablans | G07F 11/60 221/124 |
| 5,433,416 | A * | 7/1995 | Johnson | B65D 23/003 248/475.1 |
| 5,553,710 | A | 9/1996 | Takama | |
| 5,775,521 | A | 7/1998 | Tisbo | |
| 6,073,766 | A | 6/2000 | Winnard | |
| 6,142,321 | A | 11/2000 | West | |
| 6,213,296 | B1 | 4/2001 | Streich | |
| 6,427,414 | B1 | 8/2002 | Wing | |
| 6,474,901 | B1 | 11/2002 | Thurston | |
| 6,614,337 | B1 | 9/2003 | Winnard | |
| 6,948,879 | B2 | 9/2005 | Sempliner | |
| 7,172,258 | B2 | 2/2007 | Bisson et al. | |
| 7,546,716 | B1 | 6/2009 | Asadurian | |
| 8,317,040 | B2 | 11/2012 | Lanning | |
| 8,336,709 | B1 | 12/2012 | Geibel | |
| 8,397,937 | B2 * | 3/2013 | Preschke | A47B 88/90 160/131 |
| 8,403,021 | B1 | 3/2013 | Peterson et al. | |
| 8,789,325 | B2 | 7/2014 | Verhaeghe | |
| 2001/0004817 | A1 | 6/2001 | Auer | |
| 2003/0184199 | A1 | 10/2003 | Jananji | |
| 2004/0177575 | A1 | 9/2004 | Posselt | |
| 2004/0194332 | A1 | 10/2004 | Allen | |
| 2007/0023374 | A1 | 2/2007 | Nawrocki | |
| 2007/0159040 | A1 | 7/2007 | Coats et al. | |
| 2007/0194071 | A1 * | 8/2007 | Hollinger | B60R 7/00 224/542 |
| 2007/0256376 | A1 * | 11/2007 | Vaes | E04F 19/0495 52/211 |
| 2008/0083753 | A1 | 4/2008 | Escobar | |
| 2008/0202976 | A1 | 8/2008 | Burgess et al. | |
| 2008/0258593 | A1 | 10/2008 | Berger | |
| 2010/0072154 | A1 | 3/2010 | Johnson | |
| 2011/0089798 | A1 | 4/2011 | Shapiro | |
| 2012/0233938 | A1 | 9/2012 | Siegel | |
| 2012/0262043 | A1 | 10/2012 | Lechert, Jr. | |
| 2012/0321378 | A1 | 12/2012 | Velez, Jr. et al. | |
| 2013/0082020 | A1 | 4/2013 | Denny | |
| 2015/0023727 | A1 | 1/2015 | Williams et al. | |
| 2015/0164301 | A1 | 6/2015 | Bartloff et al. | |

OTHER PUBLICATIONS

Hobbithouse; The HobbitHouse Illustrated Glossary of Woodworking terms; Internet article; Apr. 2009; Available at: http://www.hobbithouseinc.com/personal/woodpics/_g_IJK.htm.

Yeates, Stephen; Woodworking Jigs and Shopmade Tools; Internet merchandise; Pinterest; Available at: https://www.pinterest.com/pin/130252614197254183/?from_navigate=true.

Dongguan Meijiamei Decorative Material Co. Ltd.; Drawer Fittings DIY PVC Drawer Divider; Internet merchandise; Jun. 2016; Globalmarket; Available at: http://www.globalmarket.com/product-info/drawer-fittings-diy-pvc-drawer-divider-9174558.html.

IKEA USA; Rationell Drawer Divider Basic Unit; Internet merchandise; Pinterest; Available at: http://www.globalmarket.com/product-info/drawer-fittings-diy-pvc-drawer-divider-9174558.html.

Rico Bravo; 0joins and jigs; Internet article; Pinterest; Available at: https://www.pinterest.com/richardbates12/0joins-and-jigs/.

Rockler Woodworking and Hardware; Classic Wood Center Mount Drawer Slide; Internet merchandise; Oct. 2007; Rockler Companies, Inc. Available at: http://www.rockler.com/classic-wood-center-mount-drawer-slide?utm_source=google&utm_medium=cpc&utm_term=&utm_content=pl.

Ernst Manufacturing, Inc.; 4200CC 1.2" Drawer Divider Corner Clips II—4 Pack; Internet Merchandise; Available at: http://www.ernstmfg.com/4200CC-1-2-Drawer-Divider-Corner-Clips-II-4-Pack.aspx.

SWISCO the Replacement Hardware Authority; Plastic Drawer Divider Clip; Internet merchandise; Available at: http://www.swisco.com/divider-clip/pd/Other-Drawer_Cabinet-Replacement-Hardware/32-066.

Ernst Manufacturing, Inc.; 6015-Black 40-Tool Space Saver Wrench Rail Kit; Internet merchandise; Oct. 2011; Amazon; Available at: https://www.amazon.com/Ernst-Manufacturing-6015-Black-40-Tool-Wrench/dp/B005ZIS8QU.

Wilbur Pan; Tool Box, after Odate; Internet tutorial; Mar. 2013; Available at: http://giantcypress.net/post/44613074898/tool-box-after-odate.

Bed Bath and Beyond; Cutlery Drawer Organizer; Internet merchandise; Jan. 2012; Available at: https://www.bedbathandbeyond.com/1/3/cutlery-drawer-organizer.

Home-Complete; Silverware Kitchen Drawer Organizer—Expandable Bamboo Tray with Adjustable Dividers Eliminate Clutter—Great as a Flatware Utensil Holder,Keurig K Cup Coffee Capsules Storage or Spice Rack; Internet merchandise; Oct. 2015; Amazon; Available at: https://www.amazon.com/Silverware-Organizer-Expendable-Adjustable-Clutter-Great/dp/B00WCB5CIU.

Ningbo Winos Co., Ltd.; Honeycomb Drawer Divider; Internet merchandise; HiSupplier.com; Available at: http://winostv.en.hisupplier.com/product-791930-Honeycomb-Drawer-Divider.html.

Lifestyle Systems; White and Black Polystyrene Drawer Divider; Internet Merchandise; Jan. 2003; Available at: http://www.lifestylesystems.com/productcatalog/products_main.html.

Tony Chavira; Fort: Recycled Magnetic Acoustic Modular Partitions; Internet Article; Jul. 8, 2009; Freshhome; Available at: http://freshome.com/2009/07/08/fort-recycled-magnetic-acoustic-modular-partitions/.

K-Log; 6-pack Plastic Magnetic Dividers for Mayline Premium Steel Flat File; Internet Merchandise; Available at: http://www.k-log.com/product-m-65.

Problem Solver, Inc.; Magnetic File Dividers/ File Followers; Internet merchandise; Jan. 2007; Available at: http://www.oodlesofpartsplus.com/Magnetic%20File-%20Followers-Dividers.htm.

CaptainSaltys; Captain Saltys Coral Reef Magnetic Invisible Corner Frag Rack (Medium) CS20006; Internet merchandise; Ebay; Feb. 2008; Available at: http://www.ebay.com/itm/Coral-Reef-Magnetic-Invisible-Corner-Frag-Rack-Medium-/151039331510?pt=Coral_and_Live_Rock&hash=item232aa54cb6.

David Preece; Drawer Lock Joint Jig archive; Internet tutorial; Jan. 2009; Available at: http://www.woodworkersinstitute.com/woodworking-crafts/techniques/ancillary-equipment/jigs/drawer-lock-joint-jig/.

COVAP Incorporated; Magnetic Shelf Dividers White; Internet Merchandise; Available at: http://www.covap.com/shopdisplayproducts.asp?id=917&cat=MAGNETIC.

Totally Bamboo; Totally Bamboo Large Expandable Cutlery Tray & Drawer Organizer, 8 Compartments, 2 with Adjustable Dimensions, Beautiful and Durable Bamboo; Internet Merchandise; Oct. 2009;

(56) References Cited

OTHER PUBLICATIONS

Amazon; Available at: https://www.amazon.com/Totally-Bamboo-Expandable-Utility-Organizer/dp/B002RL9CYK/.
Aberdeen Plastics; Drawer Dividers for Large Storage Drawer; Internet Merchandise; Feb. 2012; Amazon; Available at: https://www.amazon.com/Drawer-Dividers-Large-Storage/dp/B00310PINK/.
Festool; Festool 491691 Sortainer Drawer Dividers, Small; Internet Merchandise; Oct. 2010; Amazon; Available at: https://www.amazon.com/Festool-491691-Sortainer-Drawer-Dividers/dp/B002U5SELK/.
Lipper International; Lipper International 8896 Bamboo Kitchen Drawer Dividers, Set of 2; Internet Merchandise; Nov. 2000; Amazon; Available at: https://www.amazon.com/Lipper-International-Bamboo-Kitchen-Dividers/dp/B0037LWSEK/.
Axis International Marketing; Kitchen Drawer Dividers and Organizer, Utensil and kitchen Tools Spacer Adjustable, Set of 2; Internet merchandise; Mar. 2008; Amazon; Available at: https://www.amazon.com/Axis-Expandable-Kitchen-Drawer-Divider/dp/B000WHAI9Y/.
Business & School Supply; 3-Pack of Organizer Trays for Desk, Utensils, Tools, Crafts, Vanity—15.7"×11.7"×2.0"—White; Internet merchandise; Jul. 2012; Amazon; Available at: https://www.amazon.com/3-PACK-Organizer-Utensils-Crafts-Vanity/dp/B008GXU43G/.
PCT International Search Report for PCT Application No. PCT/2017/026808.
Written Opinion of the International Searching Authority for PCT Application No. PCT/US2017/026808.

* cited by examiner

COMPARTMENT DIVIDER ASSEMBLY

FIELD OF USE

The present disclosure relates generally to modular and customizable dividers for storage compartments such as drawers, and more particularly, to various dividers, couplers, and accessory holders that form one or more sub-compartments spaces for organization.

BACKGROUND

People have generally desired to find ways to organize various personal possessions and household items, especially as a way to physically de-clutter their lives. Many individuals, for instance, use physical folders to sort, organize, and file important documents while others may utilize racks such as clothing racks and shoe racks to help assort various clothing, shoes, and accessories. The primary reasons for organizing such items may include: increasing efficiency of a limited space, boosting productivity, and creating more room and space.

One of the most common devices that is used to organize personal items is storage compartments. Storage compartments may include drawers, shelves, trays, tool boxes, and the like. Organizational products directed to these storage compartments are typically drawer dividers and storage trays, both of which may create smaller sub-compartments for these spaces.

Unfortunately, these organizational products are designed to accommodate a certain type of item, space, or compartment. Storage dividers, for instance, tend to be sized to a particular length, whereas trays tend to hold certain items of specific dimensions. Some of these proposed devices also offer a small degree of adjustability (e.g., to handle items of different sizes). The steps required to make the adjustments, however, typically can be quite cumbersome or unsatisfying.

Therefore, there is a need for a new and improved compartment divider assembly that is customizable to a user's preference. Preferably, the new compartment divider assembly is modular and robust, such that the compartment divider assembly may divide and help organize compartments of various sizes and shapes.

SUMMARY OF ILLUSTRATIVE EMBODIMENTS

To minimize the limitations in the cited references, and to minimize other limitations that will become apparent upon reading and understanding the illustrative embodiments, the present disclosure teaches a new and useful compartment divider assembly.

One embodiment may be a compartment divider assembly, comprising: a first divider having at least one dovetail groove traversing along a longitudinal axis; and a divider support groove assembly, comprising: a first support groove and a second support groove; wherein the first support groove may comprise: a first groove portion and a first dovetail portion; wherein the second support groove may comprise: a second groove portion and a second dovetail portion; wherein the first dovetail portion may have a first planar face sloping outwardly at a first dovetail angle and a second planar face sloping at a sliding angle away from the first planar face; wherein the second dovetail portion may have a third planar face sloping outwardly at a second dovetail angle and a fourth planar face sloping at the sliding angle away from the third planar face; wherein the first dovetail portion and the second dovetail portion may form a first male dovetail when the second planar face contacts the fourth planar face; wherein the first male dovetail may be adapted to slideably engage with the at least one dovetail groove; wherein the second planar face of the first dovetail portion may be adapted to contact and slide with the fourth planar face of the second dovetail portion at the sliding angle in a back and forth manner, such that the divider support groove assembly may comprise at least two configurations: a lock configuration and a release configuration; wherein the lock configuration may occur when the first planar face of the first dovetail portion contacts and engages a first inner side of the at least one dovetail groove and when the second planar face of the second dovetail portion contacts and engages with a second inner side of the at least one dovetail groove while the second planar face and the fourth planar face are in contact with each other; wherein the release configuration may occur when the first groove portion and the second groove portion are slid proximally towards each other and the second planar face and the fourth planar face are in contact with each other, such that the first planar face of the first dovetail portion is no longer in contact with the first inner side of the at least one dovetail groove and when the third planar face of the second dovetail portion is no longer in contact with the second inner side of the at least one dovetail groove; wherein the lock configuration may create a gap between the first groove portion and the second groove portion; and wherein the gap may be fitted to engage with an end of a second divider. When the divider support groove assembly is in the release configuration, the divider support groove assembly may be removed from the at least one dovetail groove. The compartment divider assembly may further comprise a corner coupler; wherein the corner coupler may comprise at least a second male dovetail and a third male dovetail; wherein the second male dovetail and the third male dovetail may be adapted to slideably engage with the at least one dovetail groove; and wherein the second male dovetail may be disposed at an angle substantially perpendicular to the third male dovetail. The compartment divider assembly may further comprise a third divider; wherein the third divider may comprise at least one dovetail groove traversing along a longitudinal axis; and wherein the second male dovetail and the third male dovetail may be adapted to slideably engage with the at least one dovetail groove of the third divider. The second male dovetail of the corner coupler may be positioned at substantially a same height of the third male dovetail. The second male dovetail of the corner coupler may be positioned at a height different from the third male dovetail. The compartment divider assembly may further comprise an accessory holder assembly; wherein the accessory holder assembly may comprise at least one small support piece, at least one large support piece, and a fourth male dovetail; wherein the at least one small support piece and the at least one large support piece may each comprise a dovetail groove; and wherein the fourth male dovetail may be adapted to slideably engage with the dovetail grooves of the at least one small support piece and the at least one large support piece, such that the at least one small support piece and the at least one large support piece may form a recess adapted to receive an accessory. An end of the accessory holder assembly may be dimensioned to engage and fit within the gap of the first groove portion and the second groove portion of the divider support groove assembly. The first divider may comprise at least two dovetail grooves traversing along the longitudinal axis; and wherein the at least two dovetail grooves may be a first divider dovetail groove and a second divider dovetail groove; wherein the first divider dovetail groove may be located at a first side of the first divider; wherein the second divider dovetail groove may be located at a second side of the first divider; and wherein the first divider dovetail groove and the second divider dovetail groove may be disposed at different heights. The first divider may comprise at least three dovetail grooves traversing along the longitudinal axis; and wherein the at least three dovetail grooves may be a first divider dovetail groove, a second divider dovetail groove, and a third divider dovetail groove. The first divider dovetail groove and the third divider dovetail groove may be located at a first side of the first divider; and wherein the second divider dovetail groove may be positioned at a second side of the first divider.

Another embodiment may be a compartment divider assembly, comprising: a first divider having at least one dovetail groove traversing along a longitudinal axis; a second divider; and a divider support groove assembly, comprising: a first support groove and a second support groove; wherein the first support groove may comprise: a first groove portion and a first dovetail portion; wherein the second support groove may comprise: a second groove portion and a second dovetail portion; wherein the first dovetail portion may have a first planar face traversing along the longitudinal axis and sloping outwardly at a first dovetail angle and a second planar face sloping at a sliding angle away from the first planar face; wherein the second dovetail portion may have a third planar face traversing along the longitudinal axis and sloping outwardly at a second dovetail angle and a fourth planar face sloping at the sliding angle away from the third planar face; wherein the first dovetail portion and the second dovetail portion may form a first male dovetail when the second planar face contacts the fourth planar face; wherein the first male dovetail may be adapted to slideably engage with the at least one dovetail groove; wherein the second planar face of the first dovetail portion may be adapted to contact and slide with the fourth planar face of the second dovetail portion at the sliding angle in a back and forth manner, such that the divider support groove assembly comprises at least two configurations: a lock configuration and a release configuration; wherein the lock configuration may occur when the first planar face of the first dovetail portion contacts and engages a first inner side of the at least one dovetail groove and when the second planar face of the second dovetail portion contacts and engages with a second inner side of the at least one dovetail groove while the second planar face and the fourth planar face are in contact each other; wherein the release configuration may occur when the first groove portion and the second groove portion are slid proximally towards each other and the second planar face and the fourth planar face are in contact with each other, such that the first planar face of the first dovetail portion is no longer in contact with the first inner side of the at least one dovetail groove and when the third planar face of the second dovetail portion is no longer in contact with the second inner side of the at least one dovetail groove; wherein the lock configuration may create a gap between the first groove portion and the second groove portion; wherein the gap may be fitted to engage with an end of the second divider; and wherein when the divider support groove assembly is in the release configuration, the divider support groove assembly may be removed from the at least one dovetail groove. The compartment divider assembly may further comprise a corner coupler; wherein the corner coupler may comprise at least a second male dovetail and a third male dovetail; wherein the second male dovetail and the third male dovetail may be adapted to slideably engage with the at least one dovetail groove; and wherein the second male dovetail may be disposed at an angle substantially perpendicular to the third male dovetail. The compartment divider assembly may further comprise a third divider; wherein the third divider may comprise at least one dovetail groove traversing along a longitudinal axis; and wherein the second male dovetail and the third male dovetail may be adapted to slideably engage with the at least one dovetail groove of the third divider. The second male dovetail of the corner coupler may be positioned at substantially a same height of the third male dovetail. The second male dovetail of the corner coupler may be positioned at a height different from the third male dovetail. The compartment divider assembly may further comprise an accessory holder assembly; wherein the accessory holder assembly may comprise at least one small support piece, at least one large support piece, and a fourth male dovetail; wherein the at least one small support piece and the at least one large support piece may each comprise a dovetail groove; and wherein the fourth male dovetail may be adapted to slideably engage with the dovetail grooves of the at least one small support piece and the at least one large support piece, such that the at least one small support piece and the at least one large support piece may form a recess adapted to receive an accessory. An end of the accessory holder assembly may be dimensioned to engage and fit within the gap of the first groove portion and the second groove portion of the divider support groove assembly. The first divider may comprise at least two dovetail grooves traversing along the longitudinal axis; and wherein the at least two dovetail grooves may be a first divider dovetail groove and a second divider dovetail groove; wherein the first divider dovetail groove may be located at a first side of the first divider; wherein the second divider dovetail groove may be located at a second side of the first divider; and wherein the first divider dovetail groove and the second divider dovetail groove may be disposed at different heights. The first divider may comprise at least three dovetail grooves traversing along the longitudinal axis; and wherein the at least three dovetail grooves may be a first divider dovetail groove, a second divider dovetail groove, and a third divider dovetail groove. The first divider dovetail groove and the third divider dovetail groove may be located at a first side of the first divider; and wherein the second divider dovetail groove may be positioned at a second side of the first divider, such that the first divider dovetail groove, the second divider dovetail groove, and the third divider dovetail groove are disposed at opposite sides of the first divider in an alternating fashion.

It is an object to provide a compartment divider assembly that is customizable and readily adaptable to a wide variety of different applications without structural modification.

It is another object to provide a compartment divider assembly that utilizes a variety of dividers, couplers, and accessory receiving devices when customizing according to the user's preferences.

It is another object of the present invention to provide a compartment divider assembly that is versatile, powerful, cost-effective to manufacture, and effortlessly easy to use.

It is an object to overcome the limitations of the prior art.

Other features and advantages are inherent in the compartment divider assembly claimed and disclosed will become apparent to those skilled in the art from the following detailed description and its accompanying drawings.

BRIEF DESCRIPTION OF THE DRAWINGS

The drawings are of illustrative embodiments. They do not illustrate all embodiments. Other embodiments may be used in addition or instead. Details which may be apparent or unnecessary may be omitted to save space or for more effective illustration. Some embodiments may be practiced with additional components or steps and/or without all of the components or steps which are illustrated. When the same numeral appears in different drawings, it refers to the same or like components or steps.

DETAILED DESCRIPTION OF THE DRAWINGS

Figure 1A:
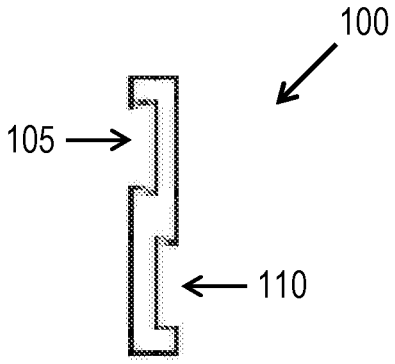
FIGS. 1A through 1D are illustrations of one embodiment of a divider.

In the following detailed description of various embodiments of the invention, numerous specific details are set forth in order to provide a thorough understanding of various aspects of one or more embodiments of the invention.

However, one or more embodiments of the invention may be practiced without some or all of these specific details. In other instances, well-known methods, procedures, and/or components have not been described in detail so as not to unnecessarily obscure aspects of embodiments of the invention.

While multiple embodiments are disclosed, still other embodiments of the present invention will become apparent to those skilled in the art from the following detailed description, which shows and describes illustrative embodiments of the invention. As will be realized, the invention is capable of modifications in various obvious aspects, all without departing from the spirit and scope of the present invention. Accordingly, the screen shot figures, and the detailed descriptions thereof, are to be regarded as illustrative in nature and not restrictive. Also, the reference or non-reference to a particular embodiment of the invention shall not be interpreted to limit the scope of the invention.

In the following description, certain terminology is used to describe certain features of one or more embodiments of the invention. For instance, the term "divider" refers to any device or strip of material that is used to couple with another divider in order to compartmentalize and/or divide a given space. As used herein, the term "accessory" generally refers to a tool or device that is used to fit within a space of a compartment, such as a confined space, drawer, file cabinet, file cabinet drawer, and/or the like.

As used herein, the term "dovetail groove" generally refers to any substantially elongated slot, depression, or trench on a divider, wherein the inner side or relief of the slot, depression, or trench facing a mouth or opening is greater in size than the mouth or opening itself. An example of a dovetail groove may include T-Tracks. The dovetail groove may be constructed of any shape, so long as the inner side is larger than the mouth or opening of the slot, depression, or trench.

As used herein, the term "dovetail" generally refers to any anchoring device, including tapered projection devices or inwardly-projecting anchoring devices, having a terminal end that is larger than the connected or truncated end. In various embodiments, the "dovetail" may be capable of forming a joint with a dovetail groove. An example of a dovetail may also include a T-dovetail.

As used herein, the term "substantially perpendicular" refers to an angle of roughly or approximately 90° to a given line, plane, or surface. In various embodiments, "substantially perpendicular" may also refer to reasonably acute angles and reasonably obtuse angles.

As used herein, the terms "approximately" and "about" generally refer to a deviance of within 15% of the indicated number or range of numbers. In one embodiment, the term "approximately" and "about", refer to a deviance of between 1-40% from the indicated number or range of numbers.

Figure 1B:
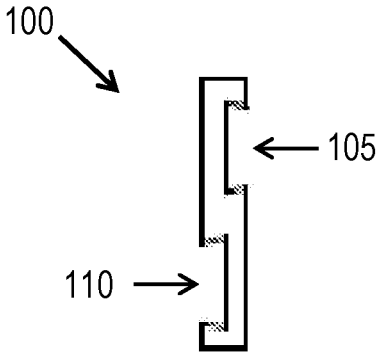
Figure 1C:
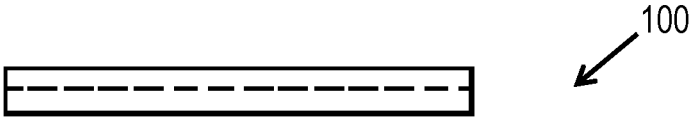
Figure 1D:
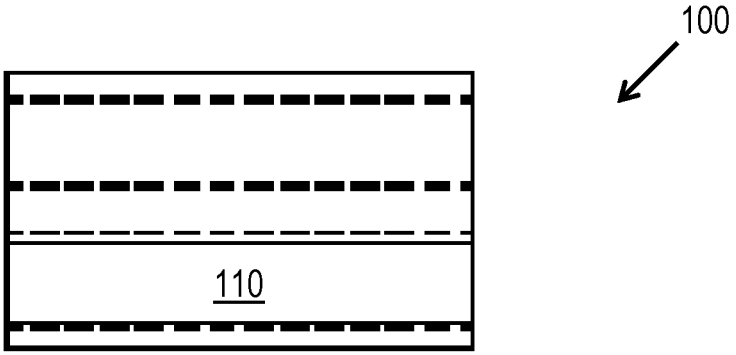

FIGS. 1A through 1D are illustrations of several views of one embodiment of a divider. FIG. 1A is an elevational right-side view of the divider 100. FIG. 1B is an elevational left-side view of the divider 100. FIG. 1C is a top plan view of the divider 100. FIG. 1D is a front elevational view of the divider 100. As shown in FIGS. 1A through 1D, one embodiment of the divider 100 may comprise dovetail grooves 105, 110 that traverse or travel across a longitudinal path. These dovetail grooves 105, 110 generally allow the divider 100 to couple or removeably attach to additional dividers via male dovetails. In particular, additional dividers having male dovetails may be inserted through the dovetail grooves 105, 110 and slide through the dovetail grooves 105, 110. The dovetail grooves 105, 110 are tapered or angled sided channels, as shown in FIGS. 1A to 1D.

Figure 2A:
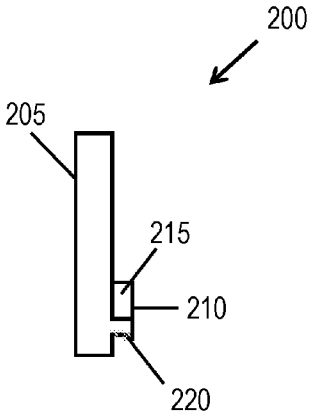
FIGS. 2A through 2C are illustrations of one embodiment of a first support groove.
Figure 2B:
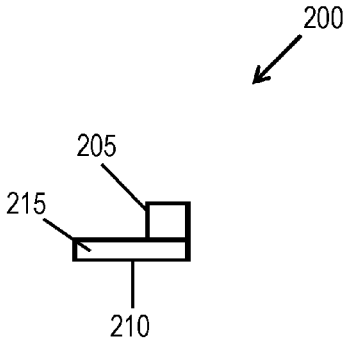
Figure 2C:
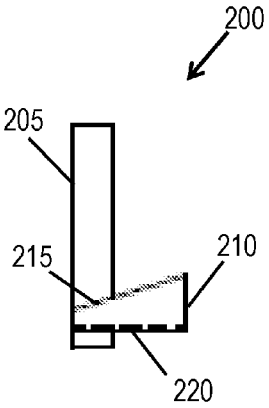

FIGS. 2A through 2C are illustrations of several views of one embodiment of a first support groove. FIG. 2A is an elevational right-side view of the first support groove 200. FIG. 2B is a top plan view of the first support groove 200. FIG. 2C is a front elevational view of the first support groove 200. As shown in FIGS. 2A through 2C, one embodiment of the first support groove 200 may comprise a first groove portion 205 and a first dovetail portion 210. The first groove portion 205 may be disposed in a substantially vertical manner, and the first dovetail portion 210 may be disposed in a generally horizontal manner. The first groove portion 205 may be coupled or integral to the first dovetail portion 210, such that at least one side of the first groove portion 205 is disposed in a substantially perpendicular or reasonably acute or obtuse angle with respect to at least one side of the first dovetail portion 210.

Importantly, FIG. 2A shows that the first dovetail portion 210 may have a first planar face 220 sloping outwardly at a first dovetail angle, and FIG. 2C shows that the first dovetail portion 210 may have a second planar face 215 sloping at a sliding angle away from the first planar face 220. This will allow the first dovetail portion 210 of the first support groove 200 to form a male dovetail when the second planar face 215 of the first dovetail portion 210 contacts a fourth planar face 315 the second dovetail portion 310 (shown in FIGS. 4A-4B). The sliding angle of the second planar face 215 also may be adapted to contact and slide with the second dovetail portion 310, thereby allowing the male dovetail to form a lock configuration and a release configuration (shown in FIG. 4B).

Figure 3A:
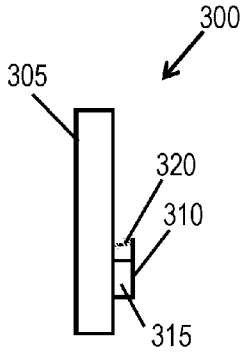
FIGS. 3A through 3C are illustrations of one embodiment of a second support groove.
Figure 3B:
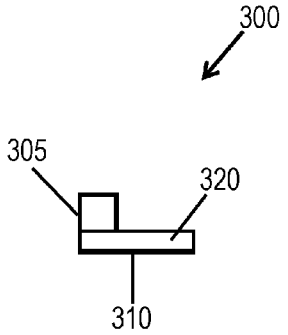
Figure 3C:
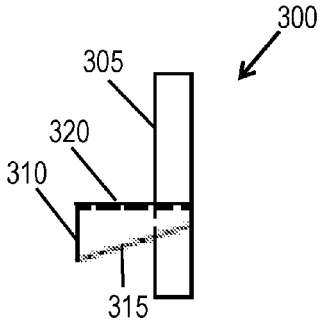

FIGS. 3A through 3C are illustrations of several views of one embodiment of a second support groove. FIG. 3A is an elevational left-side view of the second support groove 300. FIG. 3B is a top plan view of the second support groove 300. FIG. 3C is a front elevational view of the second support groove 300. As shown in FIGS. 3A through 3C, one embodiment of the second support groove 300 may comprise a second groove portion 305 and a second dovetail portion 310. The second groove portion 305 may be disposed in a substantially vertical manner, and the second dovetail portion 310 may be disposed in a generally horizontal manner. The second groove portion 305 may be coupled or integral to the second dovetail portion 310, such that at least one side of the second groove portion 305 may be disposed in a substantially perpendicular or reasonably acute or obtuse angle with respect to at least one side of the second dovetail portion 310.

Importantly, FIG. 3A shows that the second dovetail portion 310 may have a third planar face 320 sloping outwardly at a second dovetail angle, and FIG. 3C shows that the second dovetail portion 310 may have a fourth planar face 315 sloping at a sliding angle away from the third planar face 320. This will allow the second dovetail portion 310 of the second support groove 300 to form a male dovetail when the fourth planar face 315 of the second dovetail portion 310 contacts the second planar face 215 of the first dovetail portion 210 (shown in FIGS. 4A-4B). The sliding angle of the second planar face 215 also may be adapted to contact and slide with the second dovetail portion 310, thereby allowing the male dovetail to form a lock configuration and a release configuration (shown in FIG. 4B).

Figure 4A:
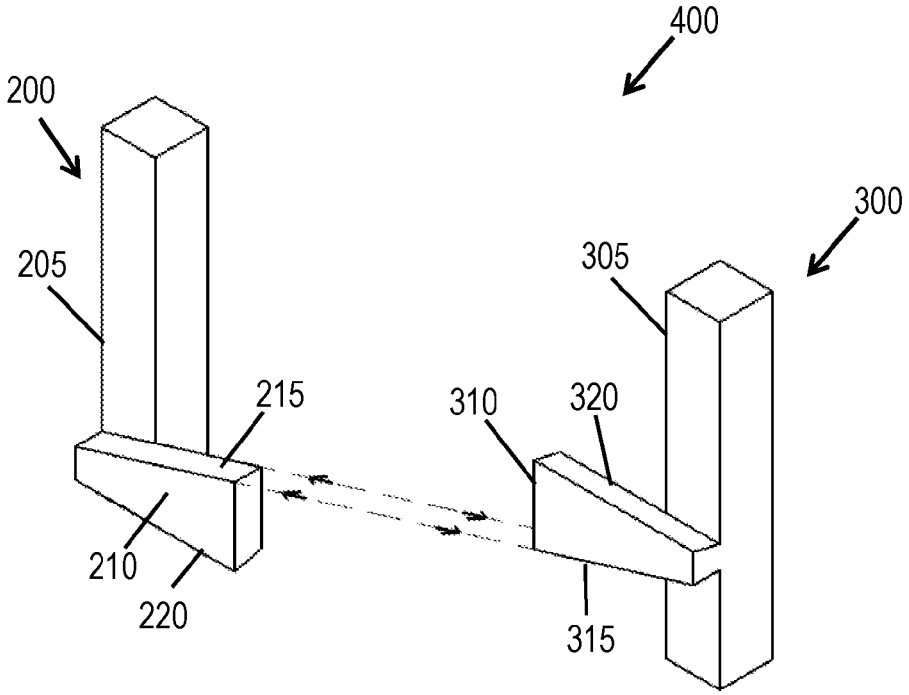
FIGS. 4A through 4B are illustrations of one embodiment of the divider support groove assembly and shows how the first support groove and second support groove engage with one another.
Figure 4B:
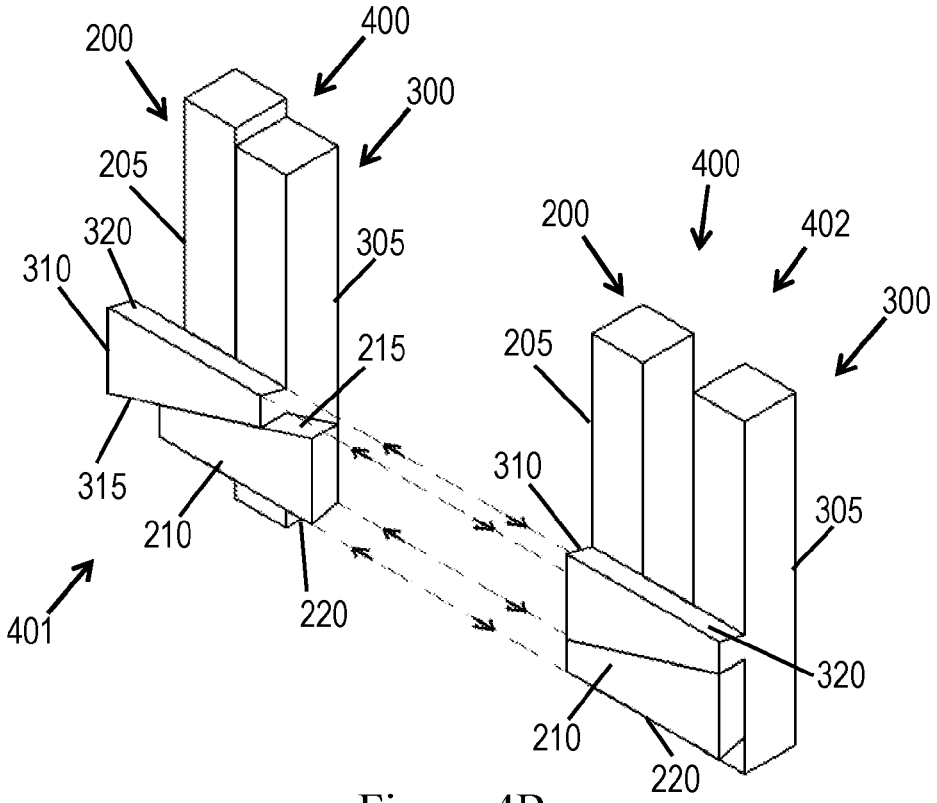

FIGS. 4A through 4B are illustrations of one embodiment of the divider support groove assembly and shows how the first support groove and second support groove engage with one another. Specifically, FIG. 4A shows the first support groove 200 and second support groove 300 separated, and FIG. 4B shows the first support groove 200 and second support groove 300 engaged together in two different positions. As shown in FIGS. 4A and 4B, one embodiment of the divider support groove assembly 400 may comprise a first support groove 200 and second support groove 300. FIG. 4A shows that the first support groove 200 may engage with the second support groove 300 by having the second planar face 215 of the first support groove 200 contact with the fourth planar face 315 of the second support groove 300. In this manner, the first dovetail portion 210 and the second dovetail portion 310 may slide with respect to one another at a sliding angle. The sliding, in turn, may cause the height or thickness of the male dovetail to increase or decrease. In particular, when the first groove portion 205 slides towards the second groove portion 305 via sliding between the second planar face 215 and the fourth planar face 315, the height of the male dovetail preferably decrease into a release configuration 401. On the other hand, when the first groove portion 205 slides away from the second groove portion 305 via sliding between the second planar face 215 and the fourth planar face 315, the height or thickness of the male dovetail preferably increases or enlarges into the lock configuration 402. This preferably allows the male dovetail of the divider support groove assembly 400 to lock into a dovetail groove.

Figure 5A:
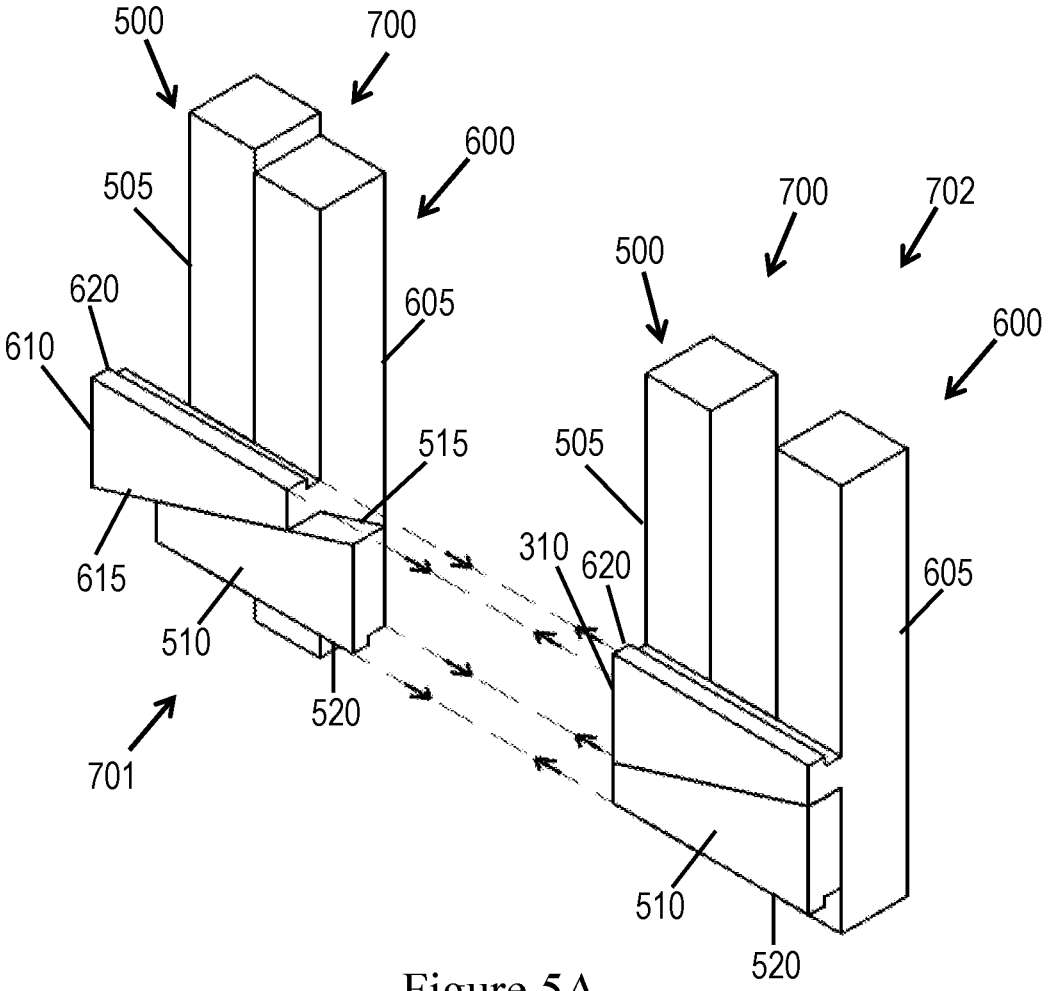
FIGS. 5A through 5B are illustrations of another embodiment of the divider support groove assembly and divider, respectively.
Figure 5B:
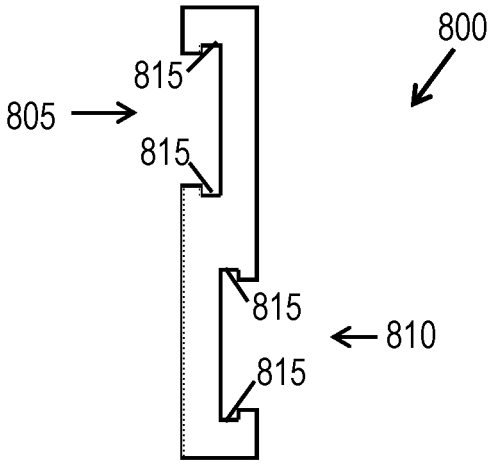

FIGS. 5A through 5B are illustrations of another embodiment of the divider support groove assembly and divider, respectively. As shown in FIG. 5A, another embodiment of the divider support groove assembly 700 may comprise a first support groove 500 and second support groove 600. Importantly, FIGS. 5A and 5B show that the divider support groove assembly and divider may utilize a male T-dovetail and T-Tracks, which are preferably another embodiment of the male dovetail and dovetail groove, respectively. FIG. 5A shows that the first support groove 500 may engage with the second support groove 600 by having the second planar face 515 of the first support groove 500 contact with the fourth planar face 615 of the second support groove 600. In this manner, the first dovetail portion 510, which may be a first T-dovetail portion, and the second dovetail portion 610, which may be a second T-dovetail portion, may contact each other to form a male T-dovetail, which may be another embodiment of the male dovetail. The first dovetail portion 510 and the second dovetail portion 610 may then slide with respect to one another at a sliding angle. The sliding, in turn, may allow the height or thickness of the male T-dovetail to increase or decrease. In particular, when the first groove portion 505 slides towards the second groove portion 605 via sliding between the second planar face 515 and fourth planar face 615, the height of the male T-dovetail preferably decrease into a release configuration 701. On the other hand, when the first groove portion 505 slides away from the second groove portion 605 via sliding between the second planar face 515 and the fourth planar face 615, the height or thickness of the male T-dovetail preferably increases or enlarges into the lock configuration 702. This preferably allows the male T-dovetail of the divider support groove assembly 700 to lock into a T-Track, which is another embodiment of the dovetail groove.

Importantly, FIG. 5A shows that the first dovetail portion 510 and the second dovetail portion 610 may comprise flanges 520, 620, which generally helps form the male T-dovetail. These flanges 520, 620 may be used to help secure the divider support groove assembly 700 onto a T-Track or dovetail groove of a divider having guides within a groove. For instance, FIG. 5B shows a side view of another embodiment of the divider 800 having grooves with guides 815. Here, the first dovetail portion 510 and second dovetail portion 610 may engage with a groove 805, 810 of the divider 800 by first forming a male T-dovetail into the release configuration 701. Once in that position, the height of the first dovetail portion 510 and second dovetail portion 610 combined may be smaller than the opening of the groove, such that the male T-dovetail may be inserted into the groove. The height of the first dovetail portion 510 and second dovetail portion 610 may then enlarge into a lock configuration 702, such that the flanges 520, 620 engage with the guides 815 of the divider 800. This preferably locks the divider support groove assembly 700 onto the groove 805, 810 of the divider 800. FIGS. 5A and 5B show that in another embodiment the T-dovetail is not angled or smoothly tapered, but may be a flange and channel design.

Figure 6A:
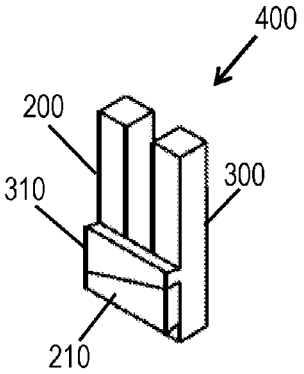
FIGS. 6A through 6C are illustrations of one embodiment of divider support groove assembly in the lock configuration.
Figure 6B:
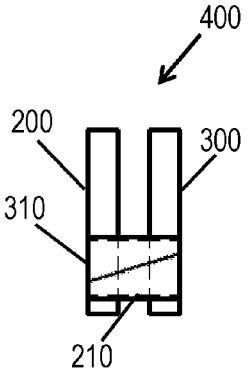
Figure 6C:
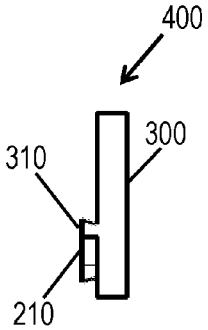

FIGS. 6A through 6C are illustrations of several views of one embodiment of the divider support groove assembly in the lock configuration. Specifically, FIG. 6A is a perspective view of the divider support groove assembly 400 in the lock configuration; FIG. 6B is a front elevational view of the divider support groove assembly 400 in the lock configuration; and FIG. 6C is a side elevational view of the divider support assembly 400 in the lock configuration. As shown in FIGS. 6A through 6C, one embodiment of the divider support groove assembly 400 may comprise a first support groove 200 and second support groove 300. FIGS. 6A through 6C also show that the height of the male dovetail formed by the first dovetail portion 210 and the second dovetail portion 310 may be larger in the lock configuration than in the release configuration, which is shown below in FIGS. 7A through 7C.

Figure 7A:
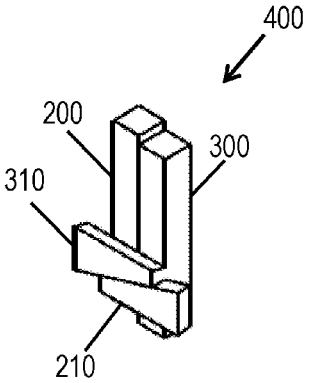
FIGS. 7A through 7C are illustrations of one embodiment of the divider support groove assembly in the release or unlocked configuration.
Figure 7B:
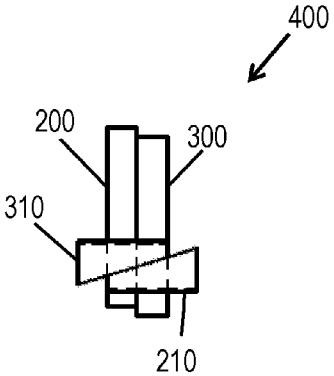
Figure 7C:
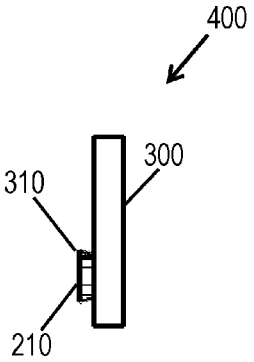

FIGS. 7A through 7C are illustrations of one embodiment of the divider support groove assembly in the release configuration. Specifically, FIG. 7A is a perspective view of the divider support groove assembly 400 in the release configuration. FIG. 7B is a front elevational view of the divider support groove assembly 400 in the release configuration, and FIG. 7C is a side elevational view of the divider support assembly 400 in the release configuration. As shown in FIGS. 7A through 7C, one embodiment of the divider support groove assembly 400 may comprise a first support groove 200 and second support groove 300. Importantly, FIGS. 7A through 7C also show that the height of the male dovetail formed by the first dovetail portion 210 and the second dovetail portion 310 may be smaller in the release configuration than in the lock configuration, which is shown above in FIGS. 6A through 6C.

Figure 8:
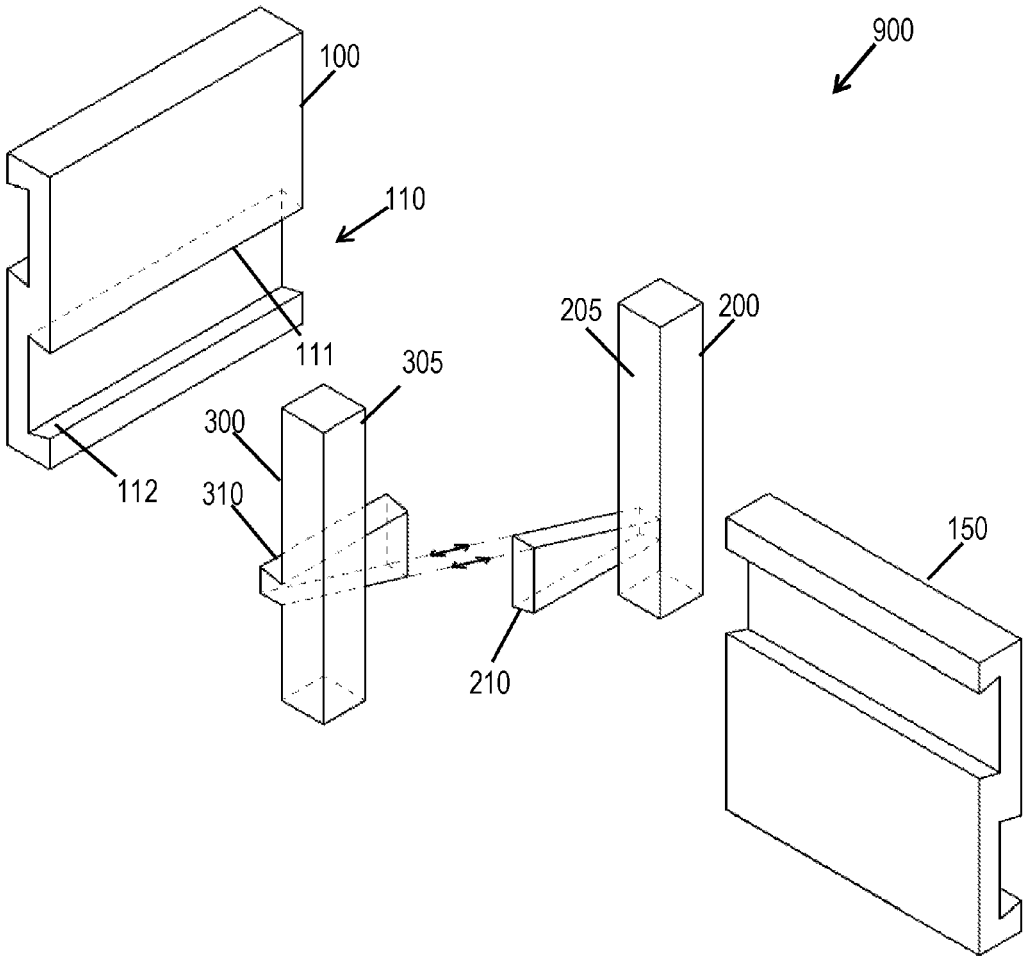
FIG. 8 is an illustration of an exploded view of one embodiment of the compartment divider assembly.

FIG. 8 is an illustration of an exploded view of one embodiment of the compartment divider assembly. As shown in FIG. 8, one embodiment of the compartment divider assembly 900 may comprise: a first divider 100, second divider 150, and divider support groove assembly, which may comprise a first support groove 200 and second support groove 300. In this embodiment, the compartment divider assembly 900 may be used to create a T connection where an end of the second divider 150 couples, attaches, or is held in place at a mid-section or area of the first divider 100. The first dovetail portion 210 of the first support groove 200 and the second dovetail portion 310 of the second support groove 300 may couple with each other and form a male dovetail in the release configuration. In this manner, the height of the male dovetail in the release configuration is then preferably adapted to fit within the edges of the dovetail groove 110, such that the male dovetail formed by the first dovetail portion 210 and the second dovetail portion 310 may be inserted within the edges of the dovetail groove 110 and fit within the inner sides 111, 112 of the dovetail groove 110.

Figure 9:
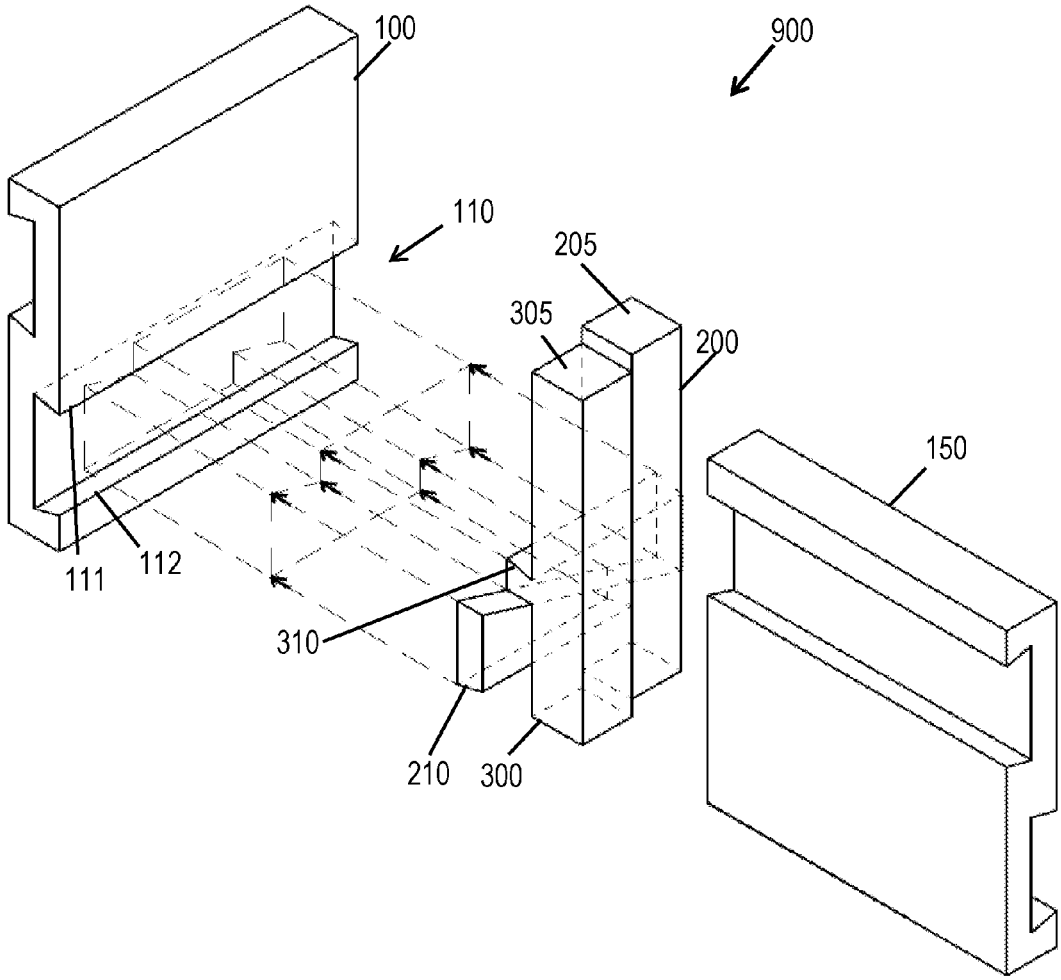
FIG. 9 is another illustration of an exploded view of one embodiment of the compartment divider assembly and shows the first support groove and second support groove in the release configuration.

FIG. 9 is another illustration of an exploded view of one embodiment of the compartment divider assembly and shows the first support groove and second support groove in the release configuration. As shown in FIG. 9, one embodiment of the compartment divider assembly 900 may comprise: a first divider 100, second divider 150, first support groove 200, and second support groove 300. FIG. 9 shows that the first support groove 200 and second support groove 300 may be engaged together in the release configuration. Once the engaged in the release configuration, the male dovetail formed by the first dovetail portion 210 and the second dovetail portion 310 may be inserted within the dovetail groove 110, as shown in FIG. 10.

Figure 10:
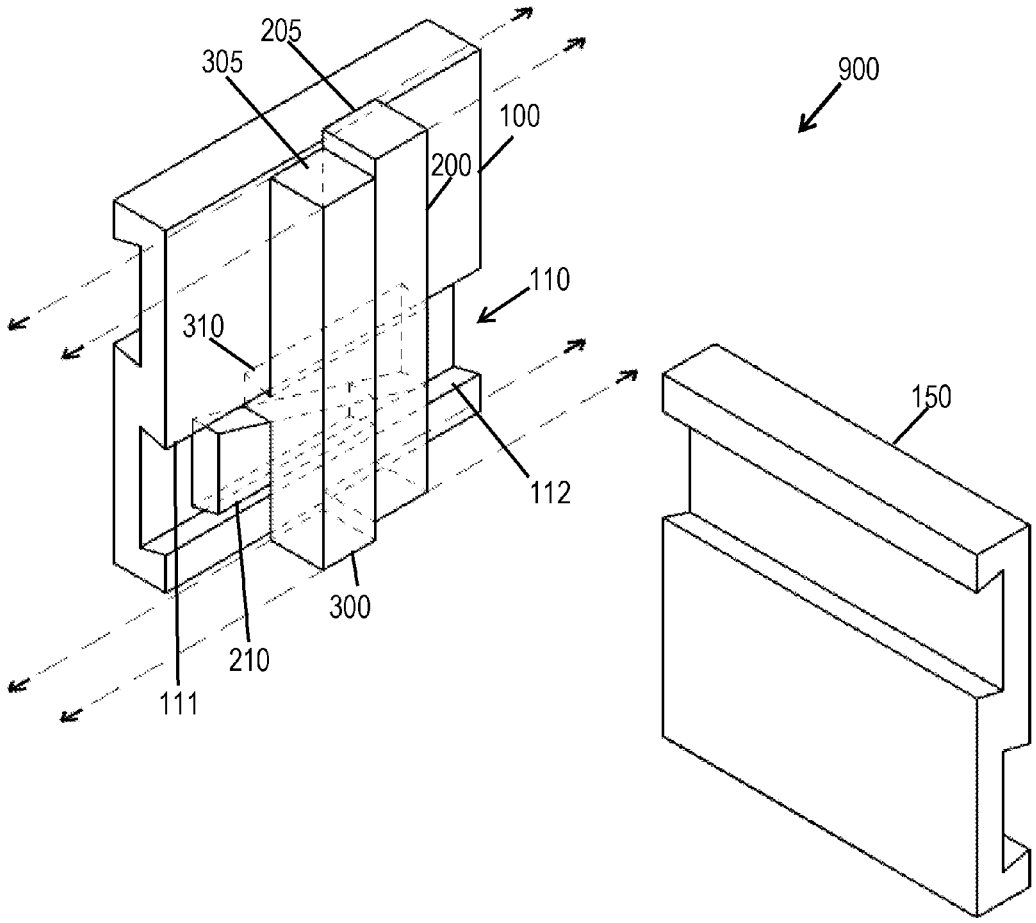
FIG. 10 is another illustration of an exploded view of one embodiment of the compartment divider assembly and shows the first support groove and second support groove in the release configuration, both of which are engaged with a dovetail groove of the first divider.

FIG. 10 is another illustration of an exploded view of one embodiment of the compartment divider assembly and shows the first support groove and second support groove in the release configuration, both of which are engaged with a dovetail groove of the first divider. As shown in FIG. 10, one embodiment of the compartment divider assembly 900 may comprise: a first divider 100, second divider 150, first support groove 200, and second support groove 300. FIG. 10 shows that the male dovetail formed by the first dovetail portion 210 and the second dovetail portion 310 may be inserted within the dovetail groove 110. Importantly, FIG. 10 shows the divider support groove assembly in the release position because the first planar face 220 and third planar face 320 of the first dovetail portion 210 and the second dovetail portion 310 may no longer be engaged or in contact with the inner sides 111, 112 of the dovetail groove 110.

Figure 11:
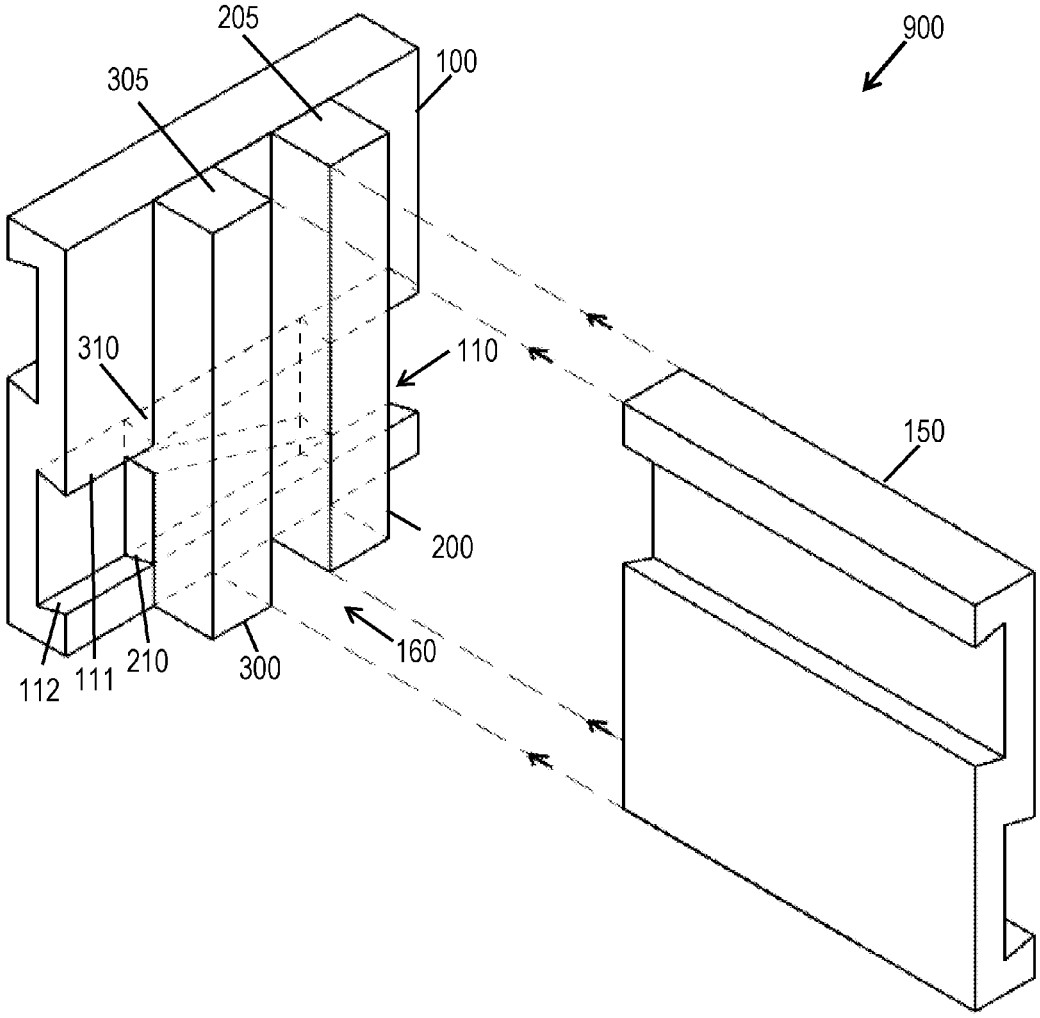
FIG. 11 is another illustration of an exploded view of one embodiment of the compartment divider assembly and shows the divider support groove assembly in the lock configuration, both of which are engaged with a dovetail groove of the first divider, before the second divider engages with a gap formed by the lock configuration of the divider support groove assembly.

FIG. 11 is another illustration of an exploded view of one embodiment of the compartment divider assembly and shows the divider support groove assembly in the lock configuration, both of which are engaged with a dovetail groove of the first divider, before the second divider engages with a gap formed by the lock configuration of the divider support groove assembly. As shown in FIG. 11, one embodiment of the compartment divider assembly 900 may comprise: a first divider 100, second divider 150, first support groove 200, and second support groove 300. FIG. 11 shows that the male dovetail formed by the first dovetail portion 210 and the second dovetail portion 310 may be inserted within the dovetail groove 110. Importantly, FIG. 11 also shows the male dovetail formed by the first dovetail portion 210 and the second dovetail portion 310 to be in the lock configuration. Here, after the first support groove 200 and second support groove 300 are slid apart, the height of the male dovetail preferably increases from the release configuration. As a result, the male dovetail preferably engages with the inner sides 111, 112 of the dovetail groove 110. This in turn allows the first planar face 220 and third planar face 320 to engage with the inner sides 111, 112, respectively, such that the male dovetail is secured and flushed within the dovetail groove 110. Preferably, a gap 160 is then formed between the first groove portion 205 and the second groove portion 305. The gap 160 is then preferably dimensioned to fittingly receive an end of the second divider 150.

Figure 12:
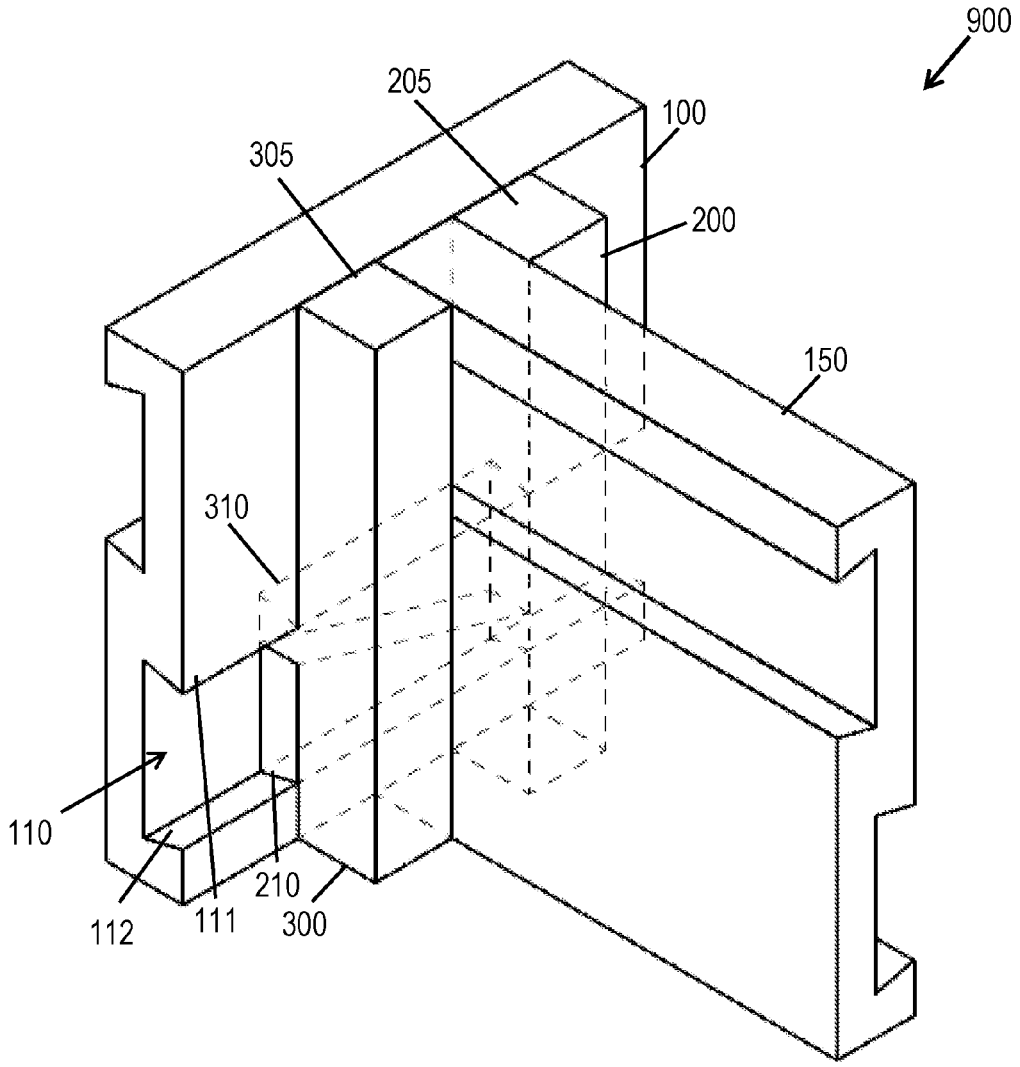
FIG. 12 is an illustration of an assembled view of one embodiment of the compartment divider assembly and shows divider support groove assembly in the lock configuration and with a second divider engaged with the gap formed by the lock configuration of the divider support groove assembly.

FIG. 12 is an illustration of an assembled view of one embodiment of the compartment divider assembly and shows divider support groove assembly in the lock configuration and with a second divider engaged with the gap formed by the lock configuration of the divider support groove assembly. As shown in FIG. 12, one embodiment of the compartment divider assembly 900 may comprise: a first divider 100, second divider 150, and divider support groove assembly, which may comprise a first support groove 200 and second support groove 300. FIG. 12 shows that after the male dovetail of the divider support groove assembly is engaged with the dovetail groove 110 of the first divider 100, the first groove portion 205 and the second groove portion 305 may create a gap 160, which, as shown, may be used to receive an end of the second divider 150. FIG. 12 shows how the assembly 900 may be used to form a divider in a compartment that is held together by tension and/or friction. The parts are held firmly in place by the sliding dovetails. Although FIG. 12 shows second divider 150 to be perpendicular to first divider 100, the second divider 150 may be positioned in various angles. Specifically, the second divider 150 may be greater than or less than 90° degrees, such that the angle between the first divider 100 and second divider 150 is acute or obtuse.

Figure 13:
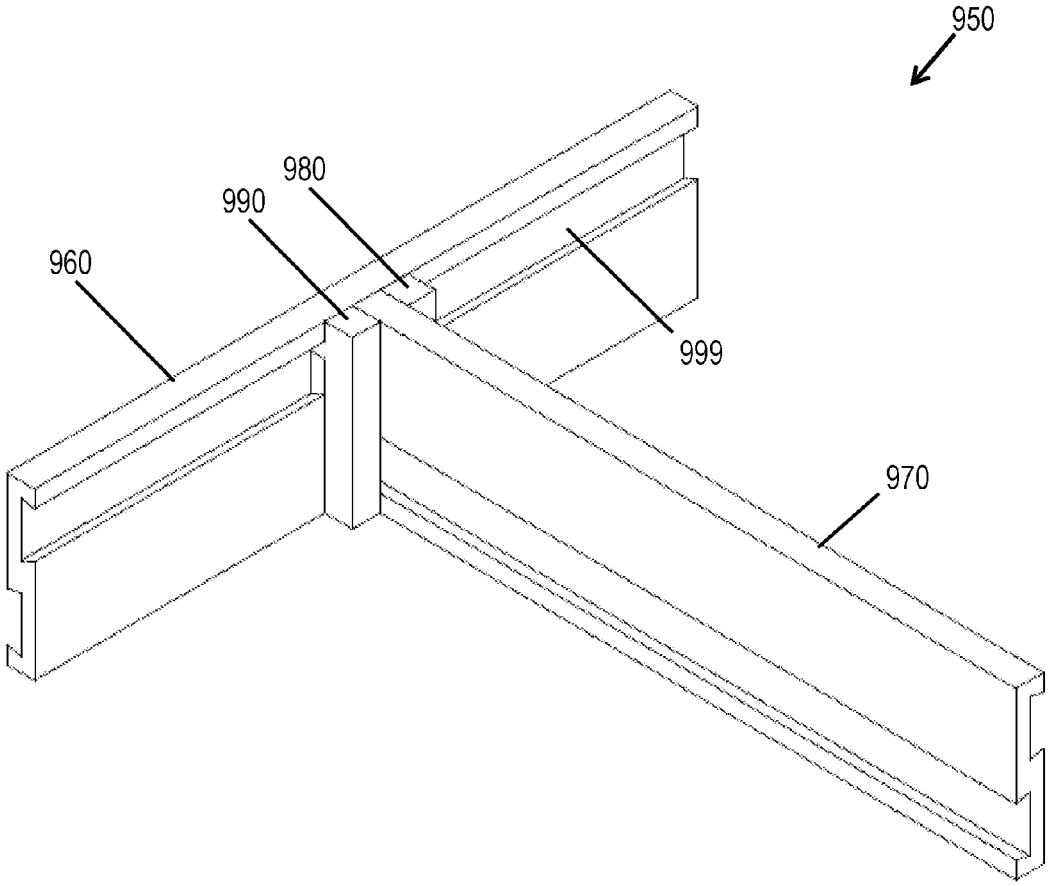
FIG. 13 is another illustration of an assembled view of another embodiment of the compartment divider assembly and shows the divider support groove assembly in the lock configuration with a second divider engaged with the gap formed by the lock configuration of the divider support groove assembly.

FIG. 13 is another illustration of an assembled view of another embodiment of the compartment divider assembly and shows the divider support groove assembly in the lock configuration with a second divider engaged with the gap formed by the lock configuration of the divider support groove assembly. As shown in FIG. 13, another embodiment of the compartment divider assembly 950 may comprise: a first divider 960, second divider 970, first support groove 980, and second support groove 990. Unlike the embodiment of the compartment divider assembly 900 shown in FIGS. 8 through 12, where the dovetail groove 110 disposed at the lower portion of the first divider 100, the compartment divider assembly 950 shown in FIG. 13 has the dovetail groove 999 disposed at the upper portion of the first divider 960. This illustrates how the compartment divider assembly 900, 950 is adapted to various orientations and allows the divider support groove assembly to be coupled or engaged with the first divider 960 at various areas.

Figure 14:
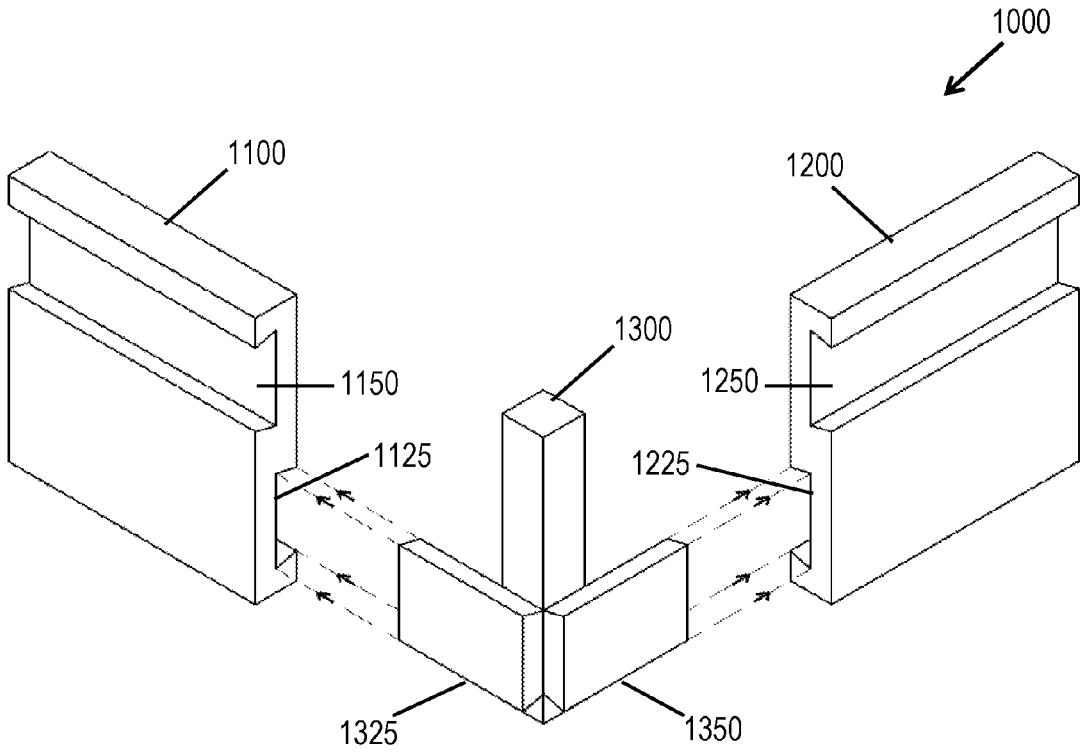
FIG. 14 is an illustration of a front exploded view of one embodiment of a corner assembly with a corner coupler having male dovetails disposed at substantially the same height.

FIG. 14 is an illustration of a front exploded view of one embodiment of a corner assembly with a corner coupler having male dovetails disposed at substantially the same height. As shown in FIG. 14, one embodiment of the corner assembly 1000 may comprise dividers 1100, 1200 and a corner coupler 1300. FIG. 14 shows that each divider 1100, 1200 may comprise two dovetail grooves 1125, 1150, 1225, 1250, such that each divider 1100, 1200 may have a two unit of height of measurement. In other embodiments, each divider may have different heights such as a single unit, triple unit, or higher unit of measurement.

FIG. 14 also shows that corner coupler 1300 may comprise male dovetails 1325, 1350. The male dovetails 1325, 1350 may be adapted to engage and slide within the dovetail grooves 1125, 1150, 1225, 1250 of the dividers 1100, 1200. This will allow the dividers 1100, 1200 to couple with one another at their ends to create a corner assembly 1000 (shown in FIG. 16). In other embodiments, the dividers 1100, 1200 may be adapted to also couple and slide with one another via the corner coupler 1300 to create a T connection as well. When coupled, the dividers 1100, 1200 are substantially immobile on an axis perpendicular to the sliding movement.

FIG. 14 shows that the male dovetails 1325, 1350 of corner coupler 1300 may be disposed near the bottom end of the corner coupler 1300 and may be at substantially the same height as the dovetail grooves 1125, 1225. This will allow the male dovetails 1325, 1350 to engage and slide with the dovetail grooves 1125, 1225, located near or at the bottom portion of the dividers 1100, 1200. Although FIG. 14 shows the male dovetails 1325, 1350 of corner coupler 1300 to be at substantially the same height and near the bottom end of the corner coupler 1300, the male dovetails 1325, 1350 may be disposed at different heights with one another and may be disposed near the top end of the corner coupler. The parts of the assembly 1000 may also be turned around, inverted, and/or flipped, such that they may connect in different ways and heights.

Figure 15:
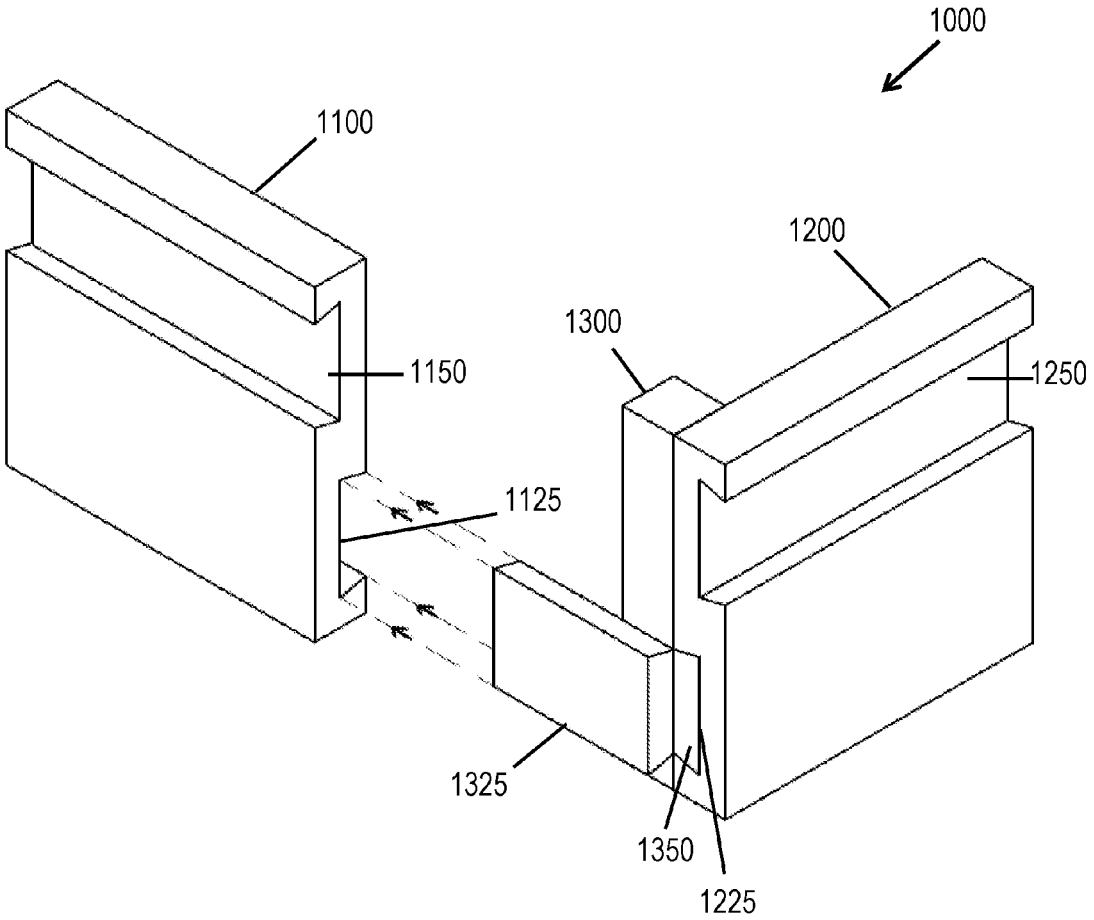
FIG. 15 is another illustration of a front exploded view of one embodiment of the corner assembly, shown in FIG. 14, and shows the second divider engaged with the corner coupler.

FIG. 15 is another illustration of a front exploded view of one embodiment of the corner assembly, shown in FIG. 14, and shows the second divider engaged with the corner coupler. As shown in FIG. 15, one embodiment of the corner assembly 1000 may comprise dividers 1100, 1200 and a corner coupler 1300. FIG. 15 shows that dovetail groove 1225 of divider 1200 may be engaged with male dovetail 1350 of corner coupler 1300. FIG. 15 shows that divider 1200 may only slide to engage with male dovetail 1350, and that the dovetailing prevents divider 1200 from being pulled perpendicularly away from corner coupler 1300.

Figure 16:
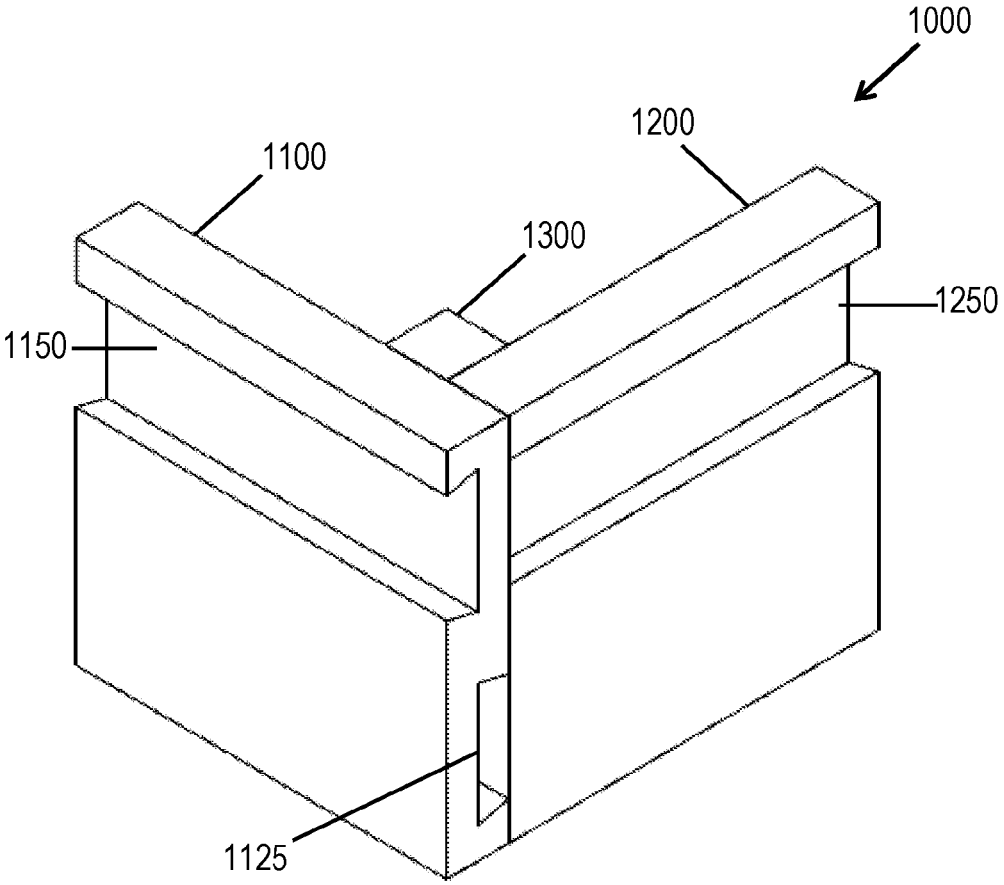
FIG. 16 is another illustration of a front assembled view of one embodiment of the corner assembly, shown in FIG. 14.

FIG. 16 is another illustration of a front assembled view of one embodiment of the corner assembly, shown in FIG. 14. As shown in FIG. 16, one embodiment of the corner assembly 1000 may comprise dividers 1100, 1200 and a corner coupler 1300. FIG. 16 shows that dovetail groove 1225 of divider 1200 may be engaged with male dovetail 1350 of corner coupler 1300 and that dovetail groove 1125 of divider 1100 may be engaged with male dovetail 1325 of corner coupler 1300. Importantly, FIG. 16 shows that divider 1100 may slide further inwards such that divider 1100 may overlap an end of the divider 1200. Either divider may slide further at the expense of the other divider. Although the stacked dovetail grooves 1125 and 1150 are show on opposite sides, it should be understood that the stacked dovetail grooves 1125 and 1150 may be on the same side in other embodiments. In other embodiments, the dovetail grooves might be on opposite sides of the divider, but at the same height, or at a partially overlapping height.

Figure 17:
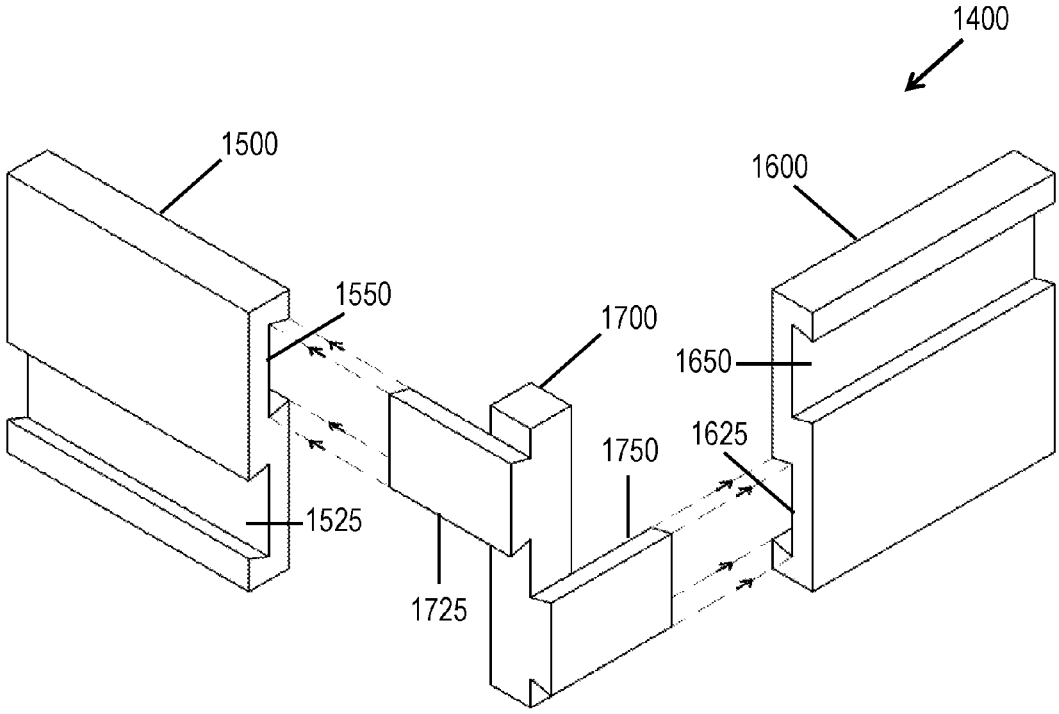
FIG. 17 is an illustration of a front exploded view of another embodiment of a corner assembly with a corner coupler having male dovetails disposed at different heights.

FIG. 17 is an illustration of a front exploded view of another embodiment of a corner assembly with a corner coupler having male dovetails disposed at different heights. As shown in FIG. 14, another embodiment of the corner assembly 1400 may comprise dividers 1500, 1600 and a corner coupler 1700. FIG. 17 shows that each divider 1500, 1600 may each comprise two dovetail grooves 1525, 1550, 1625, 1650, such that each divider 1500, 1600 may also have a two unit or double unit height of measurement. In other embodiments, each divider may have different heights as a single unit, triple unit, or higher unit of measurement. Generally, the dovetail grooves and male dovetails may be disclosed horizontally along the dividers or corner couplers, such that they may engage each other at various heights and ways.

FIG. 17 also shows that corner coupler 1700 may comprise male dovetails 1725, 1750. The male dovetails 1725, 1750 may be adapted to engage and slide within the dovetail grooves 1525, 1550, 1625, 1650 of the dividers 1500, 1600. This will allow the dividers 1500, 1600 to couple with one another at their ends to create a corner assembly 1400 (shown in FIG. 19). In other embodiments, the dividers 1500, 1600 may be adapted to also couple and slide with one another via the corner coupler 1700 to create a T connection as well.

FIG. 17 shows that male dovetail 1725 may be disposed near the top end of the corner coupler 1700 and that male dovetail 1750 may be disposed near the bottom end of the corner coupler 1700, such that the male dovetails 1725, 1750 are disposed at different heights with respect to one another. This will allow the male dovetails 1725, 1750 to engage and slide with the dovetail grooves 1550, 1625 of the dividers 1500, 1600. Although FIG. 17 shows the male dovetails 1725 of corner coupler 1700 to be near the top end of the corner coupler 1700 and that male dovetail 1750 to be near the bottom end of corner coupler 1700, male dovetail 1725 may be disposed at near the bottom end of corner coupler 1700 and male dovetail 1750 may be disposed near the top end of the corner coupler 1700. Or they may be disposed at the same height.

Figure 18:
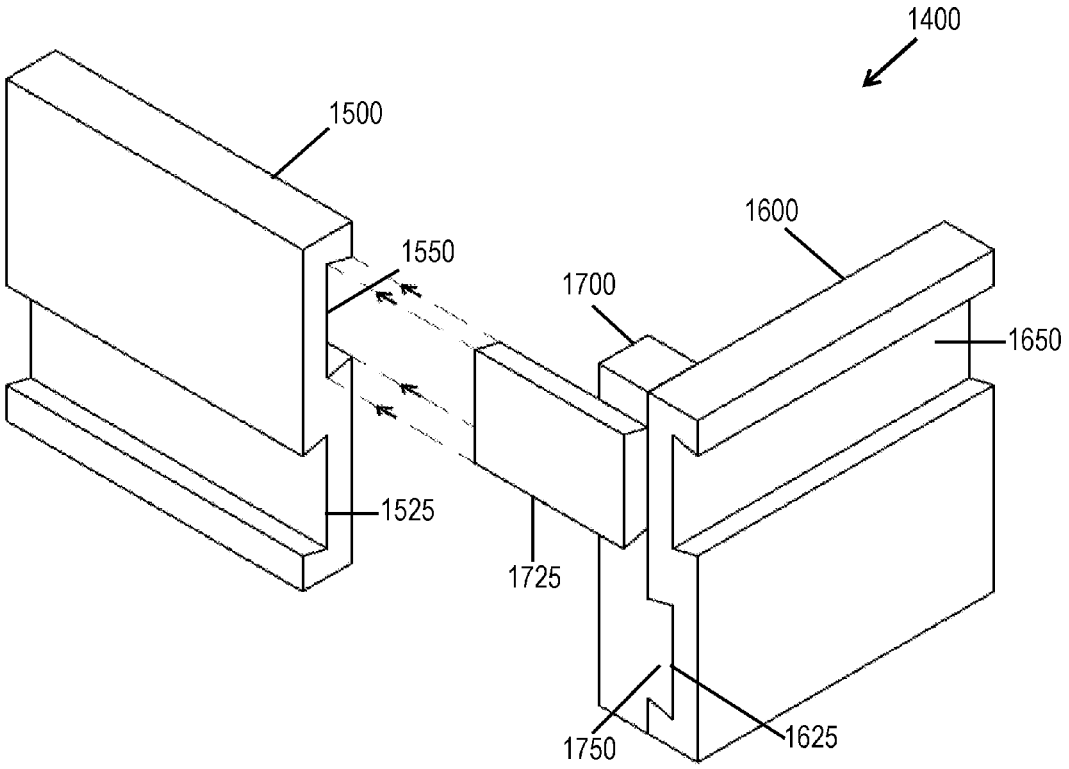
FIG. 18 is another illustration of a front exploded view of another embodiment of the corner assembly, shown in FIG. 17, and shows the second divider engaged with the corner coupler.

FIG. 18 is another illustration of a front exploded view of another embodiment of the corner assembly. As shown in FIG. 18, one embodiment of the corner assembly 1400 may comprise dividers 1500, 1600 and a corner coupler 1700. FIG. 18 shows that dovetail groove 1625 of divider 1600 may be engaged with male dovetail 1750 of corner coupler 1700.

Figure 19:
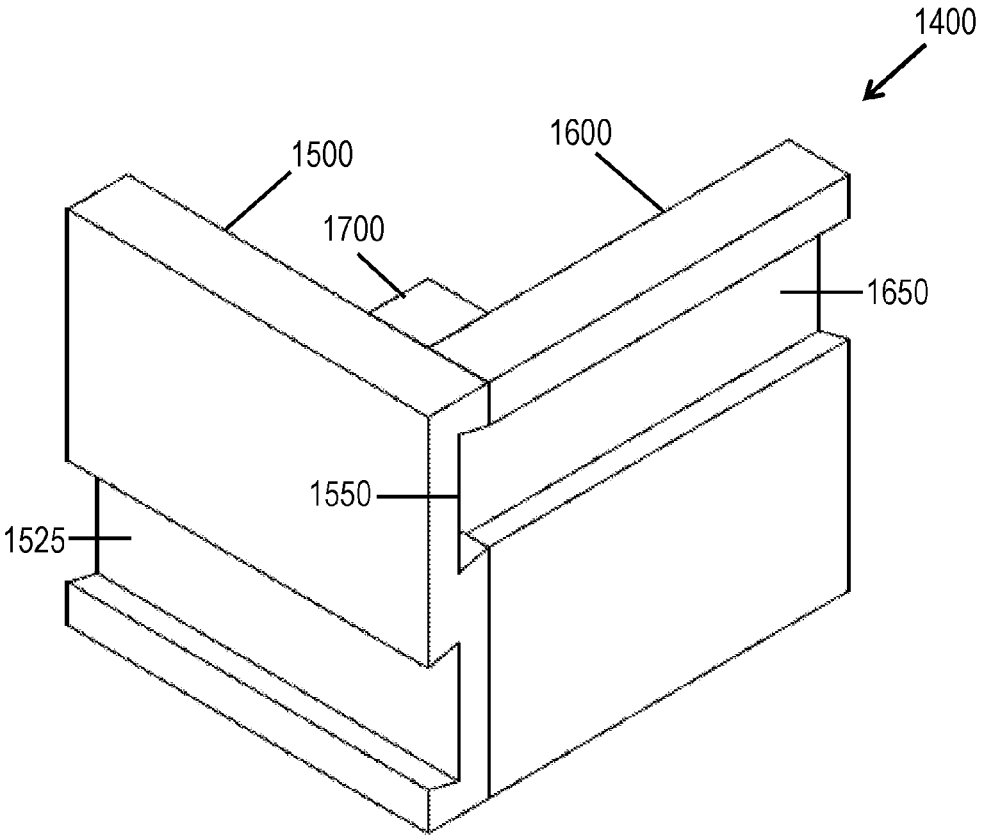
FIG. 19 is another illustration of a front assembled view of another embodiment of the corner assembly, shown in FIG. 17.

FIG. 19 is another illustration of a front assembled view of another embodiment of the corner assembly, shown in FIG. 17. As shown in FIG. 19, one embodiment of the corner assembly 1400 may comprise dividers 1500, 1600 and a corner coupler 1700. FIG. 19 shows that dovetail groove 1550 of divider 1500 may be engaged with male dovetail 1725 of corner coupler 1700 and that dovetail groove 1625 of divider 1600 may be engaged with male dovetail 1625 of corner coupler 1700. FIG. 19 shows that divider 1500 may slide further inwards such that divider 1500 may overlap an end of divider 1600, this may provide strength and support to the assembly 1400.

Figure 20:
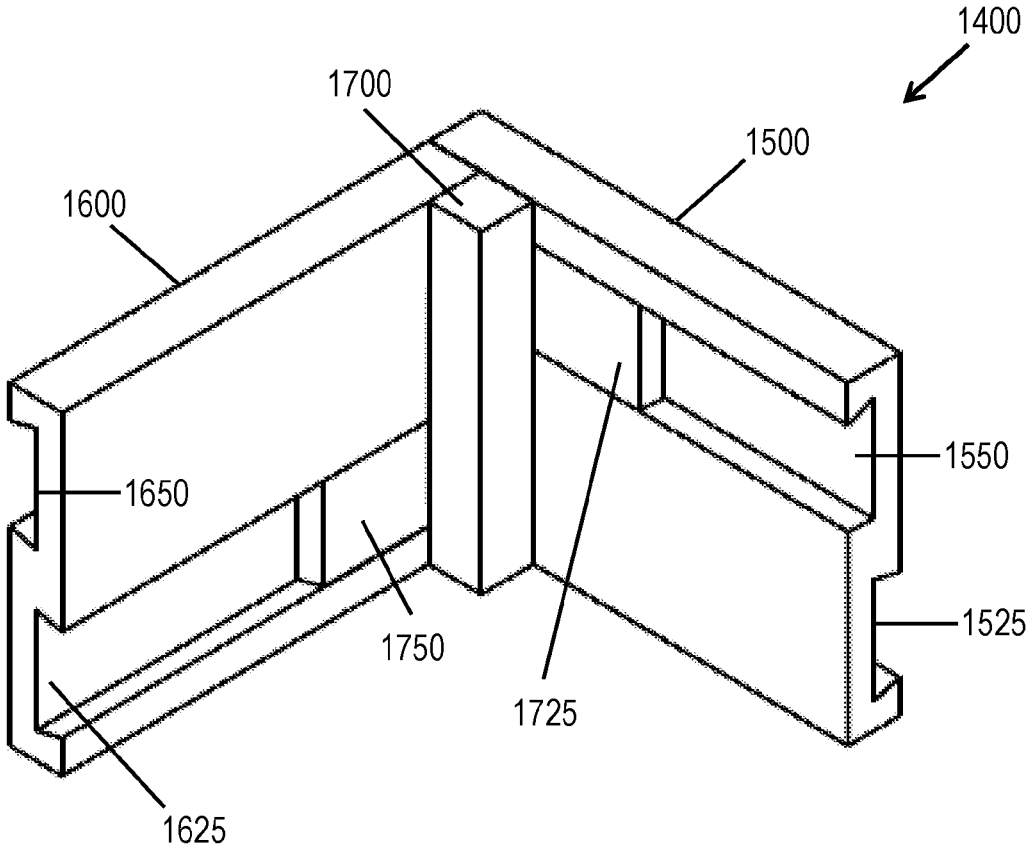
FIG. 20 is another illustration of a rear assembled view of another embodiment of the corner assembly, shown in FIG. 17.

FIG. 20 is another illustration of a rear assembled view of another embodiment of the corner assembly, shown in FIG. 17. As shown in FIG. 20, another embodiment of the corner assembly 1400 may comprise dividers 1500, 1600 and a corner coupler 1700. FIG. 20 shows that male dovetails 1725, 1750 may be engaged with dovetail grooves 1625, 1550.

Figure 21:
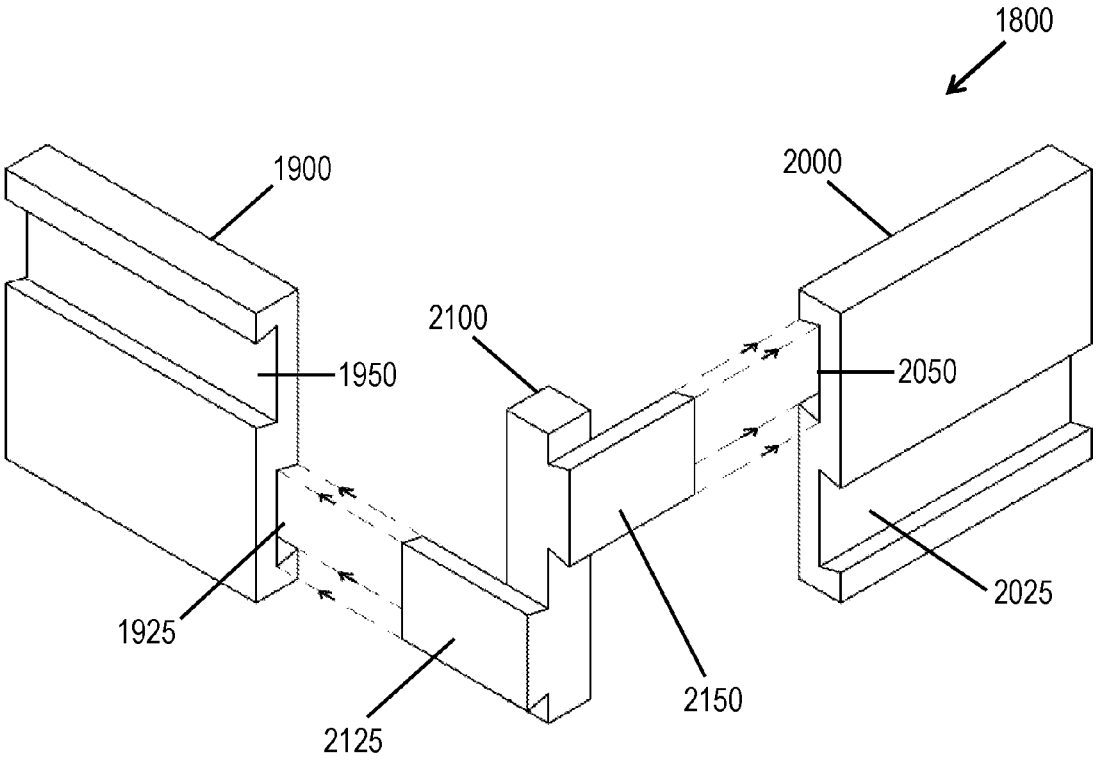
FIG. 21 is an illustration of a front exploded view of another embodiment of the corner assembly with a corner coupler having male dovetails disposed at different heights with a divider engaged with the corner coupler.

FIG. 21 is an illustration of a front exploded view of another embodiment of the corner assembly with a corner coupler having male dovetails disposed at different heights with a divider engaged with the corner coupler. As shown in FIG. 21, another embodiment of the corner assembly 1800 may comprise dividers 1900, 2000 and a corner coupler 2100. FIG. 21 shows that each divider 1900, 2000 may comprise two dovetail grooves 1925, 1950, 2025, 2050, such that each divider 1900, 2000 may also have a two unit of height of measurement. In other embodiments, each divider may have different heights such as a single unit, triple unit, or higher unit of measurement.

FIG. 21 also shows that corner coupler 2100 may comprise male dovetails 2125, 2150. The male dovetails 2125, 2150 may be adapted to engage and slide within the dovetail grooves 1925, 2050 of the dividers 1900, 2000. This will allow the dividers 1900, 2000 to couple with one another at their ends to create a corner assembly 1800 (shown in FIG. 23). In other embodiments, the dividers 1900, 2000 may be adapted to also couple and slide with one another via the corner coupler 2100 to create a T connection as well.

Importantly, FIG. 21 shows that male dovetail 2125 may be disposed near the bottom end of the corner coupler 2100 and that male dovetail 2150 may be disposed near the top end of the corner coupler 2100, such that the male dovetails 2125, 2150 are disposed at different heights with respect to one another. This will allow the male dovetails 2125, 2150 to engage and slide with the dovetail grooves 1925, 2150 of the dividers 1900, 2000. Although FIG. 20 shows the male dovetail 2125 of corner coupler 2100 to be near the bottom end of the corner coupler 2100 and that male dovetail 2150 to be near the top end of corner coupler 2100, male dovetail 2125 may be disposed at near the top end of corner coupler 2100 and male dovetail 2150 may be disposed near the bottom end of the corner coupler 2100.

Figure 22:
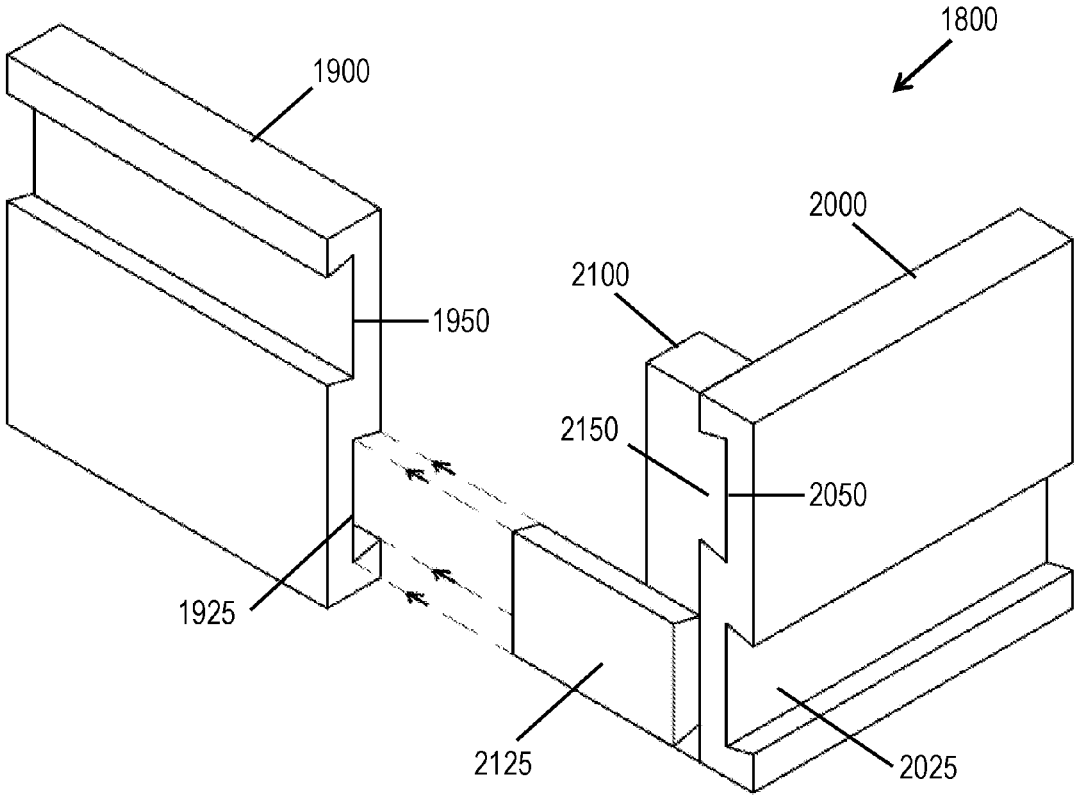
FIG. 22 is another illustration of a front exploded view of another embodiment of the corner assembly, shown in FIG. 21, and shows the second divider engaged with the corner coupler.

FIG. 22 is another illustration of a front exploded view of another embodiment of the corner assembly, shown in FIG. 21, and shows the second divider engaged with the corner coupler. As shown in FIG. 22, another embodiment of the corner assembly 1800 may comprise dividers 1900, 2000 and a corner coupler 2100. FIG. 21 shows that dovetail groove 2050 of divider 2000 may be engaged with male dovetail 2150 of corner coupler 2100.

Figure 23:
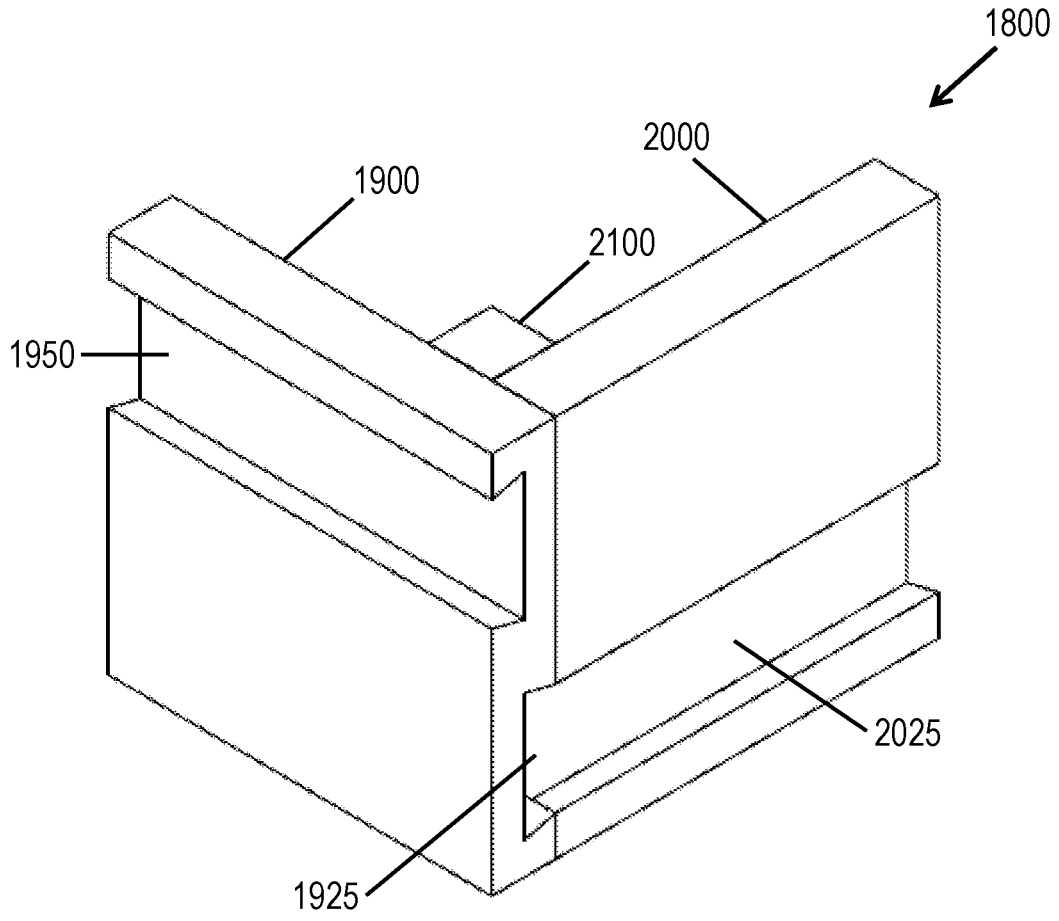
FIG. 23 is another illustration of a front assembled view of another embodiment of the corner assembly, shown in FIG. 21.

FIG. 23 is another illustration of a front assembled view of another embodiment of the corner assembly, shown in FIG. 21. As shown in FIG. 23, another embodiment of the corner assembly 1800 may comprise dividers 1900, 2000 and a corner coupler 2100. FIG. 23 shows that dovetail groove 1925 of divider 1900 may be engaged with male dovetail 2125 of corner coupler 2100 and that dovetail groove 2050 of divider 2000 may be engaged with male dovetail 2150 of corner coupler 2100. Importantly, FIG. 23 shows that divider 1900 may slide further inwards such that divider 1900 may overlap an end of divider 2000.

Figure 24:
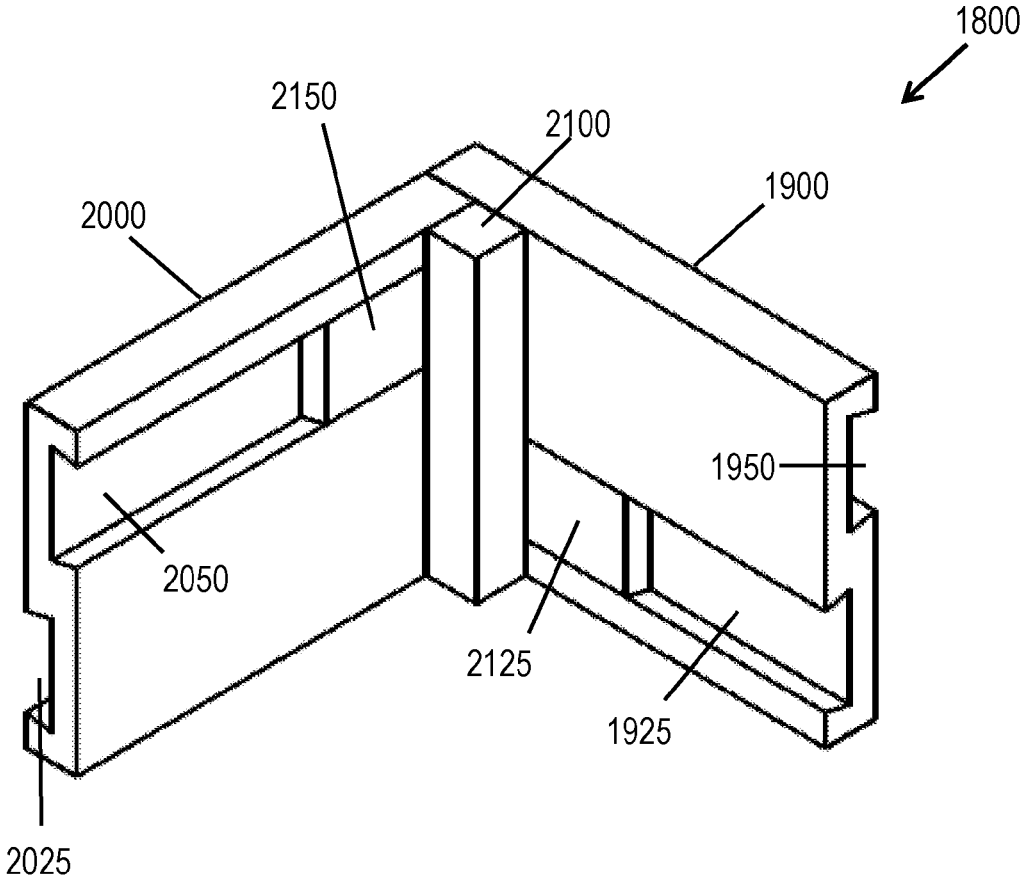
FIG. 24 is another illustration of a rear assembled view of another embodiment of the corner assembly, shown in FIG. 21.

FIG. 24 is another illustration of a rear assembled view of another embodiment of the corner assembly, shown in FIG. 21. As shown in FIG. 24, another embodiment of the corner assembly 1800 may comprise dividers 1900, 2000 and a corner coupler 2100. FIG. 24 shows that male dovetails 2125, 2150 may be engaged with dovetail grooves 1925, 2050.

Figure 25:
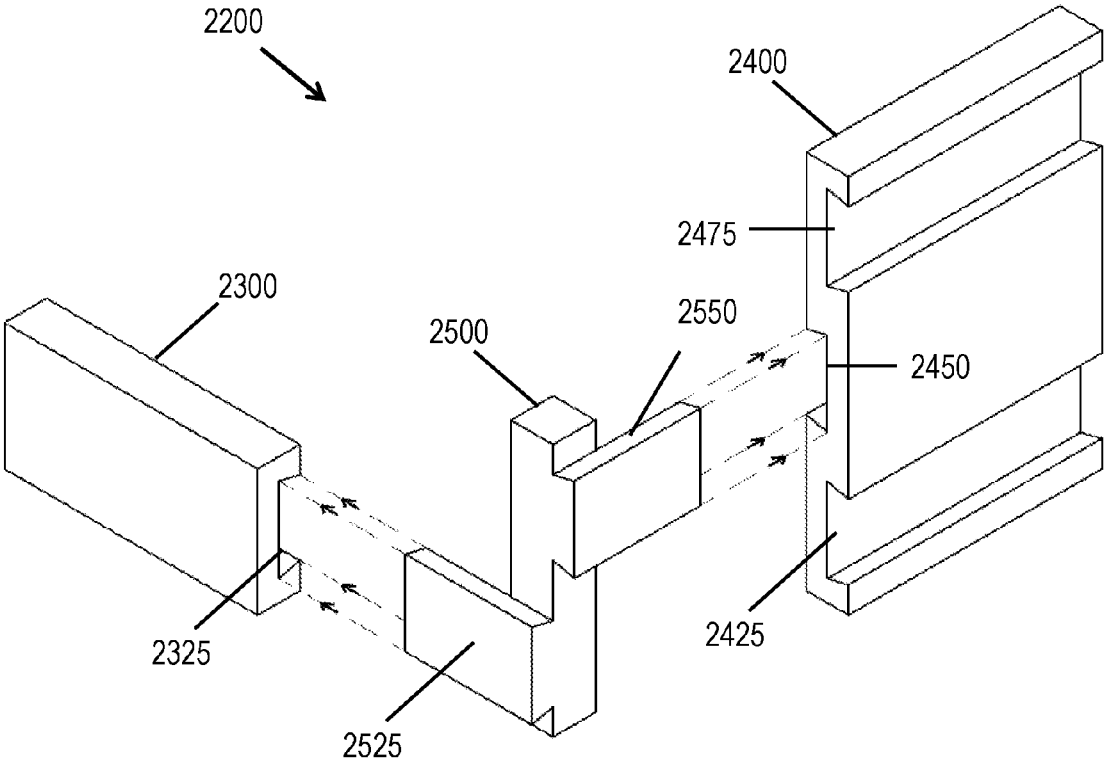
FIG. 25 is an illustration of a front exploded view of another embodiment of a corner assembly with a first divider and second divider having different heights

FIG. 25 is an illustration of a front exploded view of another embodiment of a corner assembly with a first divider and second divider having different heights. As shown in FIG. 25, another embodiment of the corner assembly 2200 may comprise dividers 2300, 2400 and a corner coupler 2500. FIG. 25 shows that divider 2300 may comprise dovetail groove 2325, such that divider 2300 may have a single unit of height of measurement. FIG. 25 also shows that divider 2400 may comprise three dovetail grooves 2425, 2450, 2475, such that divider 2400 may have three units of height of measurement. In other embodiments, each divider may have different heights such as a double unit and quadruple or more units of measurement.

FIG. 25 also shows that corner coupler 2500 may comprise male dovetails 2525, 2550. The male dovetails 2525, 2550 may be adapted to engage and slide within the dovetail grooves 2325, 2450 of dividers 2300, 2400. This will allow the dividers 2300, 2400 to couple with one another at their ends to create a corner assembly 2200. In other embodiments, the dividers 2300, 2400 may be adapted to also couple and slide with one another via the corner coupler 2500 to create a T connection as well.

FIG. 25 also shows that male dovetail 2525 may be disposed near the bottom end of the corner coupler 2500 and that male dovetail 2550 may be disposed near the top end of the corner coupler 2500, such that the male dovetails 2525, 2550 are disposed at different heights with respect to one another. This will allow the male dovetails 2525, 2550 to engage and slide with the dovetail grooves 2325, 2450 of the dividers 2300, 2400. Although FIG. 25 shows the male dovetail 2525 of corner coupler 2500 to be near the bottom end of the corner coupler 2500 and that male dovetail 2550 to be near the top end of corner coupler 2500, male dovetail 2525 may be disposed at near the top end of corner coupler 2500 and male dovetail 2550 may be disposed near the bottom end of the corner coupler 2500.

Figure 26:
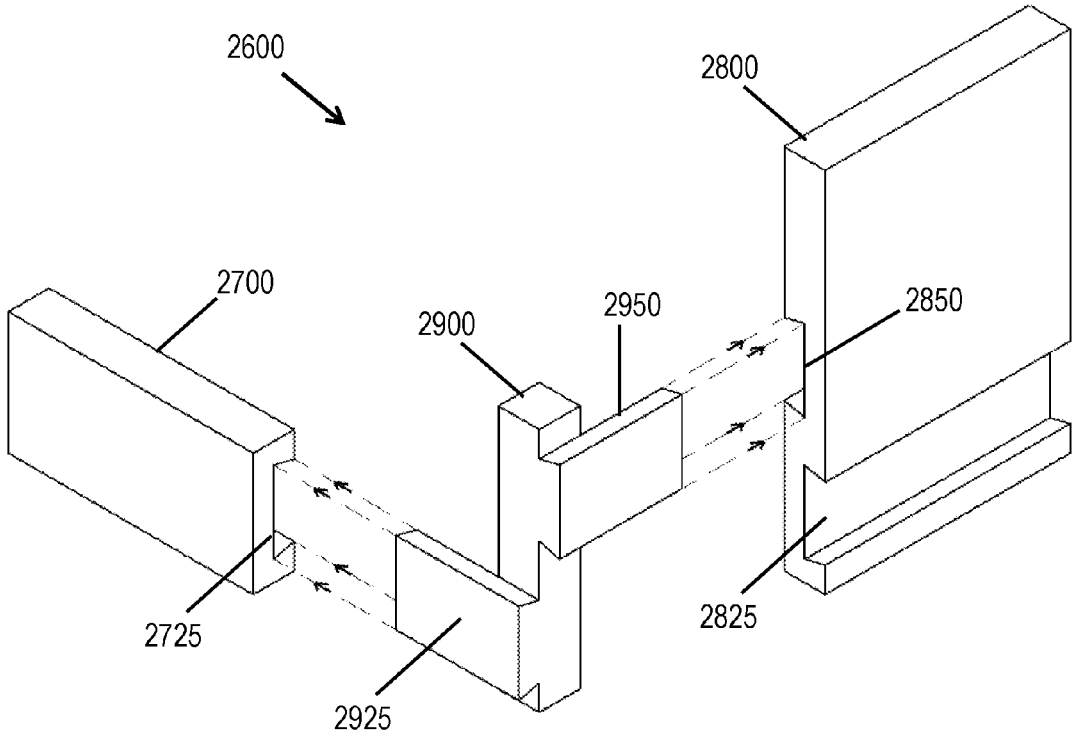
FIG. 26 is an illustration of a front exploded view of another embodiment of a corner assembly with a first divider and second divider having different heights.

FIG. 26 is an illustration of a front exploded view of another embodiment of a corner assembly with a first divider and second divider having different heights. As shown in FIG. 26, another embodiment of the corner assembly 2600 may comprise dividers 2700, 2800 and a corner coupler 2900. FIG. 26 shows that divider 2700 may comprise dovetail groove 2725, such that divider 2700 may have a single unit of height of measurement. FIG. 26 also shows that divider 2800 may comprise two dovetail grooves 2825, 2850. Although FIG. 26 shows that divider 2800 may comprise two dovetail grooves 2825, 2850, divider 2800 may be a triple unit of height of measurement. In other embodiments, each divider may have different heights such as a double unit and quadruple or more units of measurement.

FIG. 26 also shows that corner coupler 2900 may comprise male dovetails 2925, 2950. The male dovetails 2925, 2950 may be adapted to engage and slide within the dovetail grooves 2725, 2850 of dividers 2700, 2800. This will allow the dividers 2700, 2800 to couple with one another at their ends to create a corner assembly 2600. In other embodiments, the dividers 2700, 2800 may be adapted to also couple and slide with one another via the corner coupler 2900 to create a T connection as well.

FIG. 26 also shows that male dovetail 2925 may be disposed near the bottom end of the corner coupler 2900 and that male dovetail 2950 may be disposed near the top end of the corner coupler 2900, such that the male dovetails 2925, 2950 are disposed at different heights with respect to one another. This will allow the male dovetails 2925, 2950 to engage and slide with the dovetail grooves 2725, 2850 of the dividers 2700, 2800. Although FIG. 26 shows the male dovetail 2925 of corner coupler 2900 to be near the bottom end of the corner coupler 2900 and that male dovetail 2950 to be near the top end of corner coupler 2900, male dovetail 2925 may be disposed near the top end of corner coupler 2900 and male dovetail 2950 may be disposed near the bottom end of the corner coupler 2900.

Figure 27:
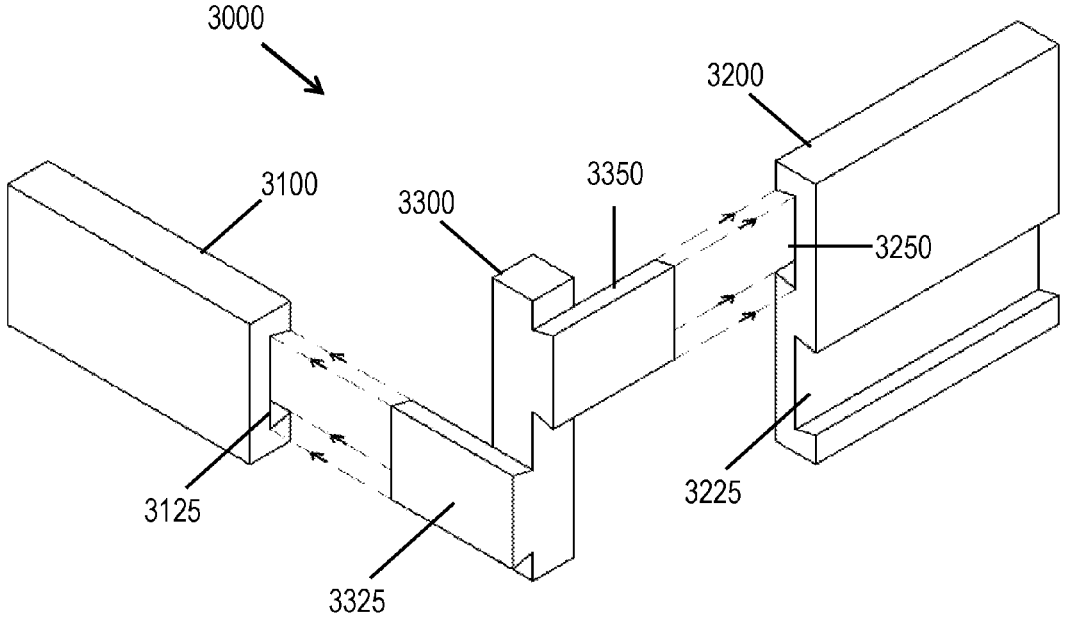
FIG. 27 is an illustration of a front exploded view of another embodiment of a corner assembly with a first divider and second divider having different heights.

FIG. 27 is an illustration of a front exploded view of another embodiment of a corner assembly with a first divider and second divider having different heights. As shown in FIG. 27, another embodiment of the corner assembly 3000 may comprise dividers 3100, 3200 and a corner coupler 3300. FIG. 27 shows that divider 3100 may comprise dovetail groove 3125, such that divider 3100 may have a single unit of height of measurement. FIG. 27 also shows that divider 3200 may comprise two dovetail grooves 3225, 3250, such that divider 3200 may be a double unit of height of measurement. In other embodiments, each divider may have different heights such as a triple unit and quadruple or more units of measurement.

FIG. 27 also shows that corner coupler 3300 may comprise male dovetails 3325, 3350. The male dovetails 3325, 3350 may be adapted to engage and slide within the dovetail grooves 3125, 3250 of dividers 3100, 3200. This will allow the dividers 3100, 3200 to couple with one another at their ends to create a corner assembly 3000. In other embodiments, the dividers 3100, 3200 may be adapted to also couple and slide with one another via the corner coupler 3300 to create a T connection as well.

FIG. 27 also shows that male dovetail 3325 may be disposed near the bottom end of the corner coupler 3300 and that male dovetail 3350 may be disposed near the top end of the corner coupler 3300, such that the male dovetails 3325, 3350 are disposed at different heights with respect to one another. This will allow the male dovetails 3325, 3350 to engage and slide with the dovetail grooves 3125, 3250 of the dividers 3100, 3200. Although FIG. 27 shows the male dovetail 3325 of corner coupler 3300 to be near the bottom end of the corner coupler 3300 and that male dovetail 3350 to be near the top end of corner coupler 3300, male dovetail 3325 may be disposed at near the top end of corner coupler 3300 and male dovetail 3350 may be disposed near the bottom end of the corner coupler 3300.

Figure 28:
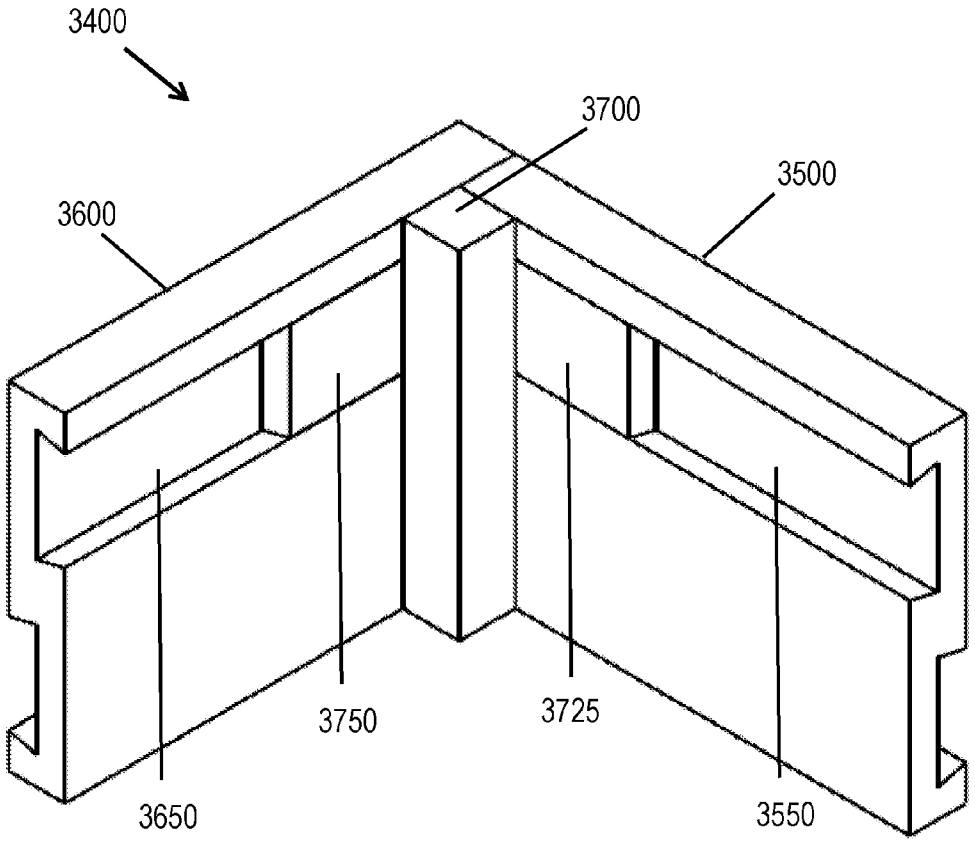
FIG. 28 is an illustration of a rear assembled view of one embodiment of the corner assembly.

FIG. 28 is an illustration of a rear assembled view of another embodiment of the corner assembly. As shown in FIG. 28, another embodiment of the corner assembly 3400 may comprise dividers 3500, 3600 and a corner coupler 3700. FIG. 28 shows that male dovetails 3750, 3725 may be engaged with dovetail grooves 3650, 3550.

The dividers shown in FIGS. 14 through 28 show various embodiments or examples of how the dovetail grooves may be arranged. By alternating the dovetail grooves in standardized increments on either side of a given divider, the flexibility of the dividers is clear.

Figure 29:
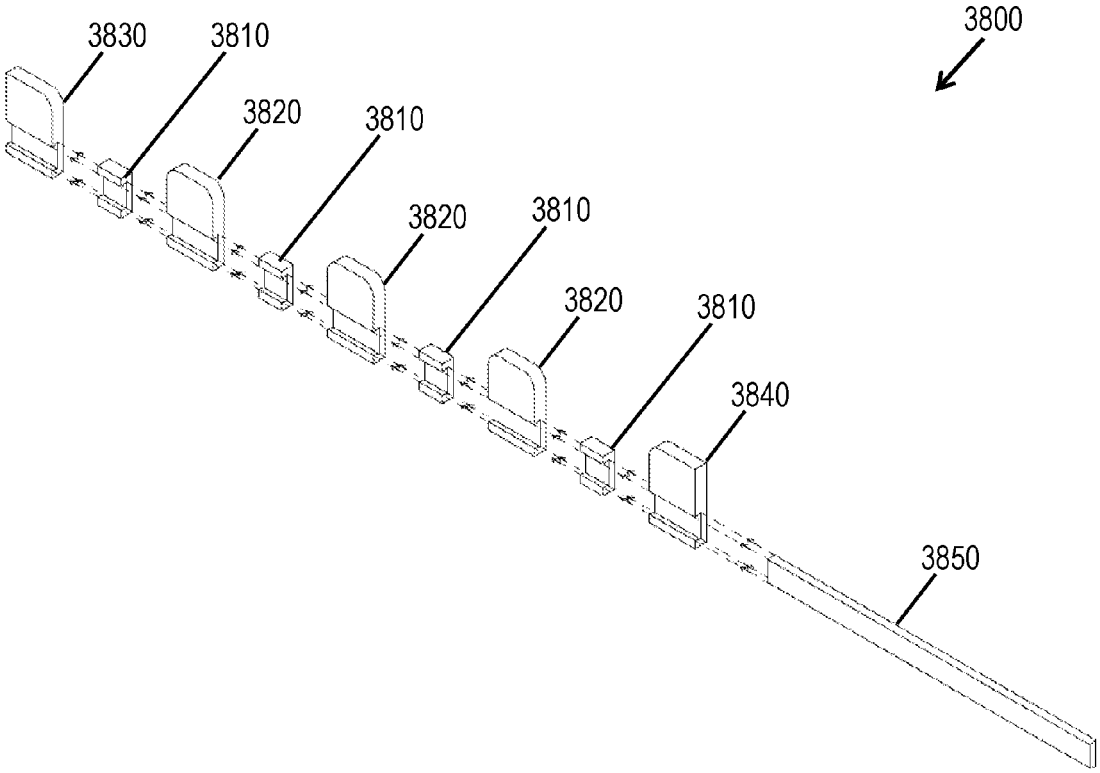
FIG. 29 is an illustration of an exploded view of one embodiment of the accessory holder assembly.

FIG. 29 is an illustration of an exploded view of one embodiment of the accessory holder assembly. As shown in FIG. 29, one embodiment of the accessory holder assembly 3800 may comprise small support pieces 3810, large support pieces 3820, 3830, 3840, and a male dovetail 3850. FIG. 29 shows that the small support pieces 3810 may have a height that is shorter than the height of the large support pieces 3820, 3830, 3840 and that the small support pieces 3810 and large support pieces 3820, 3830, 3840 may each have a dovetail groove. This may allow the small support pieces 3810 and large support pieces 3820, 3830, 3840 to align and/or couple with one another via the male dovetail 3850, which may intersect the dovetail grooves of both the small support pieces 3810 and large support pieces 3820, 3830, 3840. This may allow the large support pieces 3820, 3830, 3840 and small support pieces 3810 to form one or more receiving spaces to fit for a flexible collection of a variety of accessories. Importantly, in various embodiments, the accessory holder assembly 3800, once assembled, may also function as a divider, such that the accessory holder assembly 3800 may also be adapted to engage and securely fit one or more divider support grooves of the compartment divider assembly.

Figure 30:
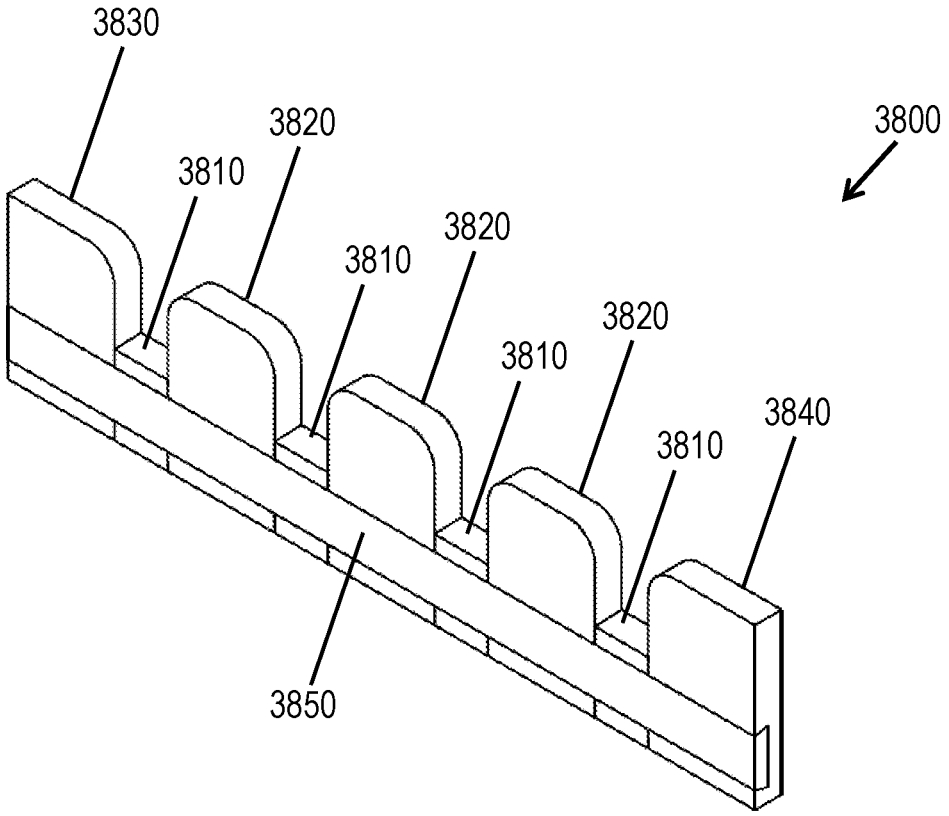
FIG. 30 is an illustration of an assembled view of one embodiment of the accessory holder assembly.

FIG. 30 is an illustration of an assembled view of one embodiment of the accessory holder assembly. As shown in FIG. 30, one embodiment of the accessory holder assembly 3800 may comprise a plurality of small support pieces 3810, a plurality of large support pieces 3820, 3830, 3840, and a male dovetail 3850. FIG. 30 shows how the small support pieces 3810 and large support pieces 3820, 3830, 3840 form a plurality of receiving spaces adapted to fit a variety of accessories such as tools or utensils. The accessory holder assembly 3800 may also function as a divider, which may engage and securely fit one or more divider support grooves of the compartment divider assembly.

Figure 31:
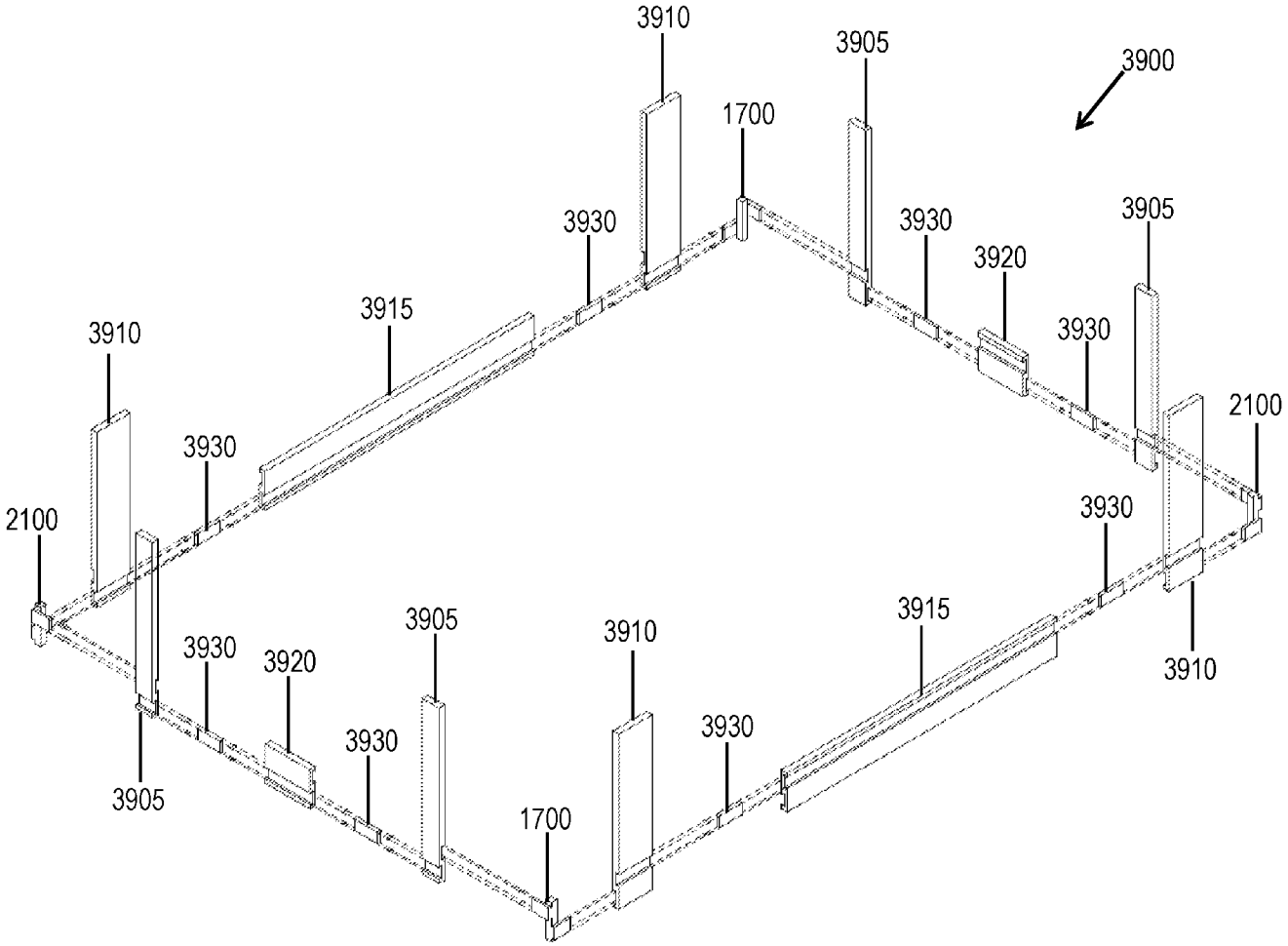
FIG. 31 is an illustration of an exploded view of one embodiment of a compartment divider assembly.

FIG. 31 is an illustration of an exploded view of one embodiment of a compartment divider assembly. As shown in FIG. 31, one embodiment of a compartment divider assembly 3900 may comprise: dividers 3915, 3920, couplers 3930, corner couplers 1700, 2100, and vertical support dividers 3905, 3910. The dividers 3915, 3920, couplers 3930, corner couplers 1700, 2100, and vertical support dividers 3905, 3910 may be coupled together to form a substantially rectangular carton kit holder (shown assembled in FIG. 32), which may be used to hold various elongated packages such as cartons of aluminum foil, wax paper, plastic wraps, and the like, all of which may be used to stack neatly within a drawer compartment. The couplers 3930, 1700, 2100 are preferably male dovetail devices that fit into dovetailed grooves of the dividers 3915, 3920, 3905, 3910. In this manner they easily slide together or apart, but are substantially prevented from being pulled apart perpendicularly to the sliding direction.

Figure 32:
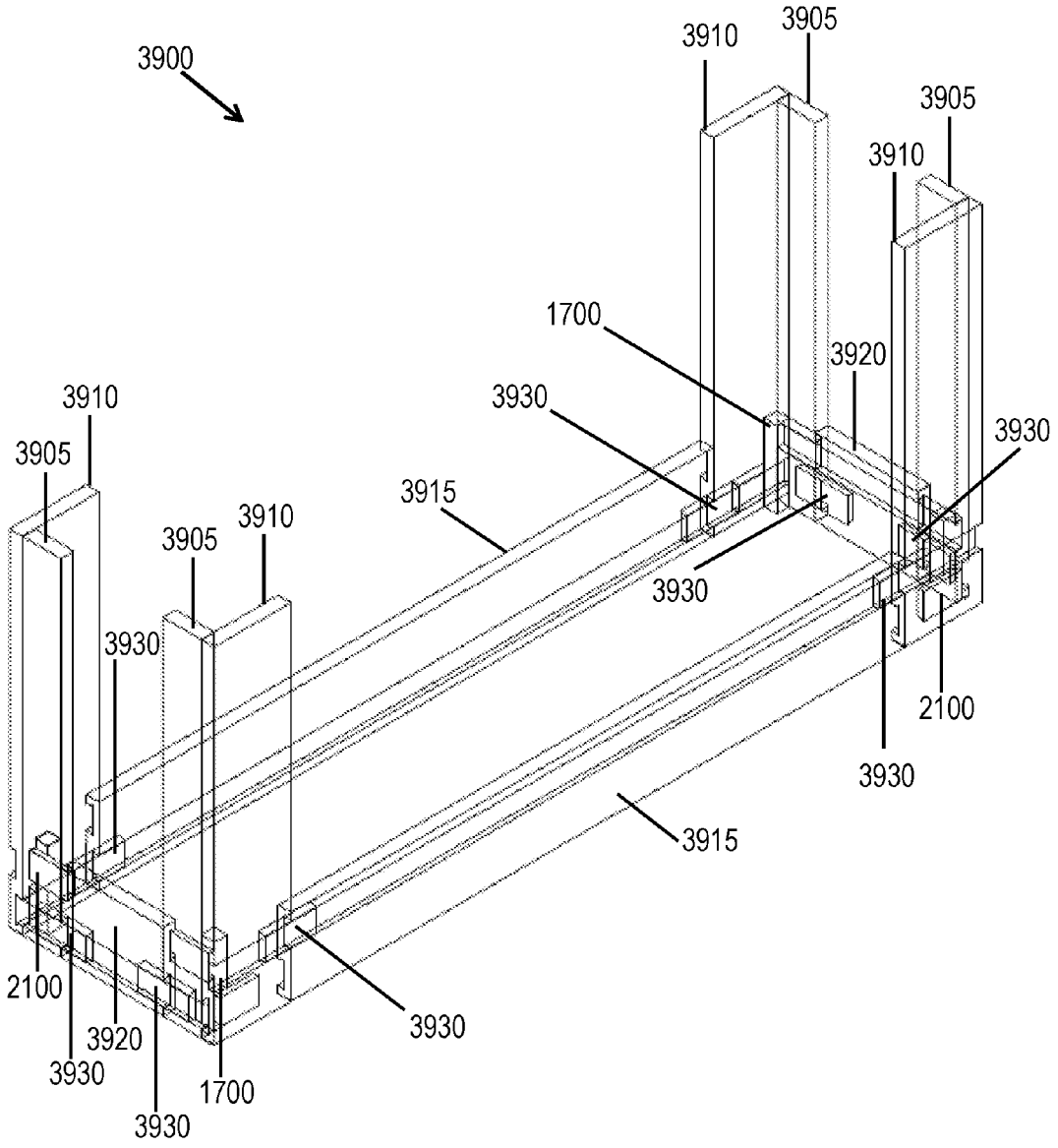
FIG. 32 is an illustration of an assembled view of one embodiment of a compartment divider assembly.

FIG. 32 is an illustration of an assembled view of one embodiment of a compartment divider assembly. As shown in FIG. 32, one embodiment of a compartment divider assembly 3900 may comprise: dividers 3915, 3920, couplers 3930, corner couplers 1700, 2100, and vertical support dividers 3905, 3910.

FIG. 32 shows how the dividers with reciprocal dovetail grooves interconnect with one another. FIG. 32 also shows how the dividers 3915, 3920 of various lengths and heights may be interconnected in numerous different ways. The divider support groove assemblies may also be used to couple to the dovetail grooves of the dividers 3915, 3920 to create additional sub-compartments within the compartment divider assembly.

Figure 33:
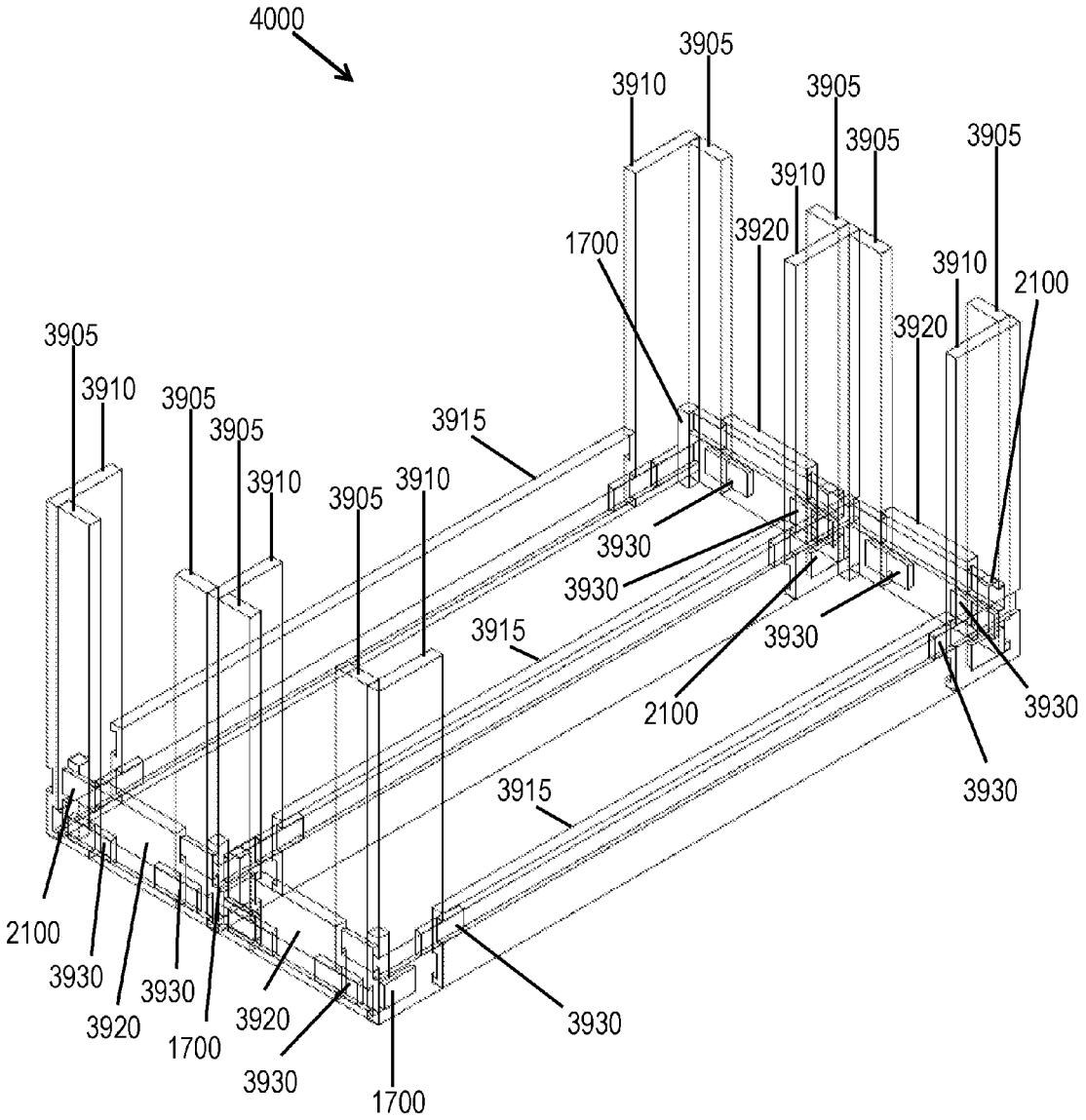
FIG. 33 is an illustration of an assembled view of another embodiment of a compartment divider assembly.

FIG. 33 is an illustration of an assembled view of another embodiment of a compartment divider assembly. As shown in FIG. 33, another embodiment of a compartment divider assembly 4000 may comprise: dividers 3915, 3920, couplers 3930, corner couplers 1700, 2100, and vertical support dividers 3905, 3910. Importantly, FIG. 33 shows how the a compartment divider assembly 4000 may include additional dividers 3915, 3920, couplers 3930, corner couplers 1700, 2100 to create a carton kit holder with a single add-on kit that holds additional elongated commodities packages. Although FIG. 33 shows a compartment divider assembly 4000 with a single add-on kit, several additional add-on kits may be added.

Figure 34:
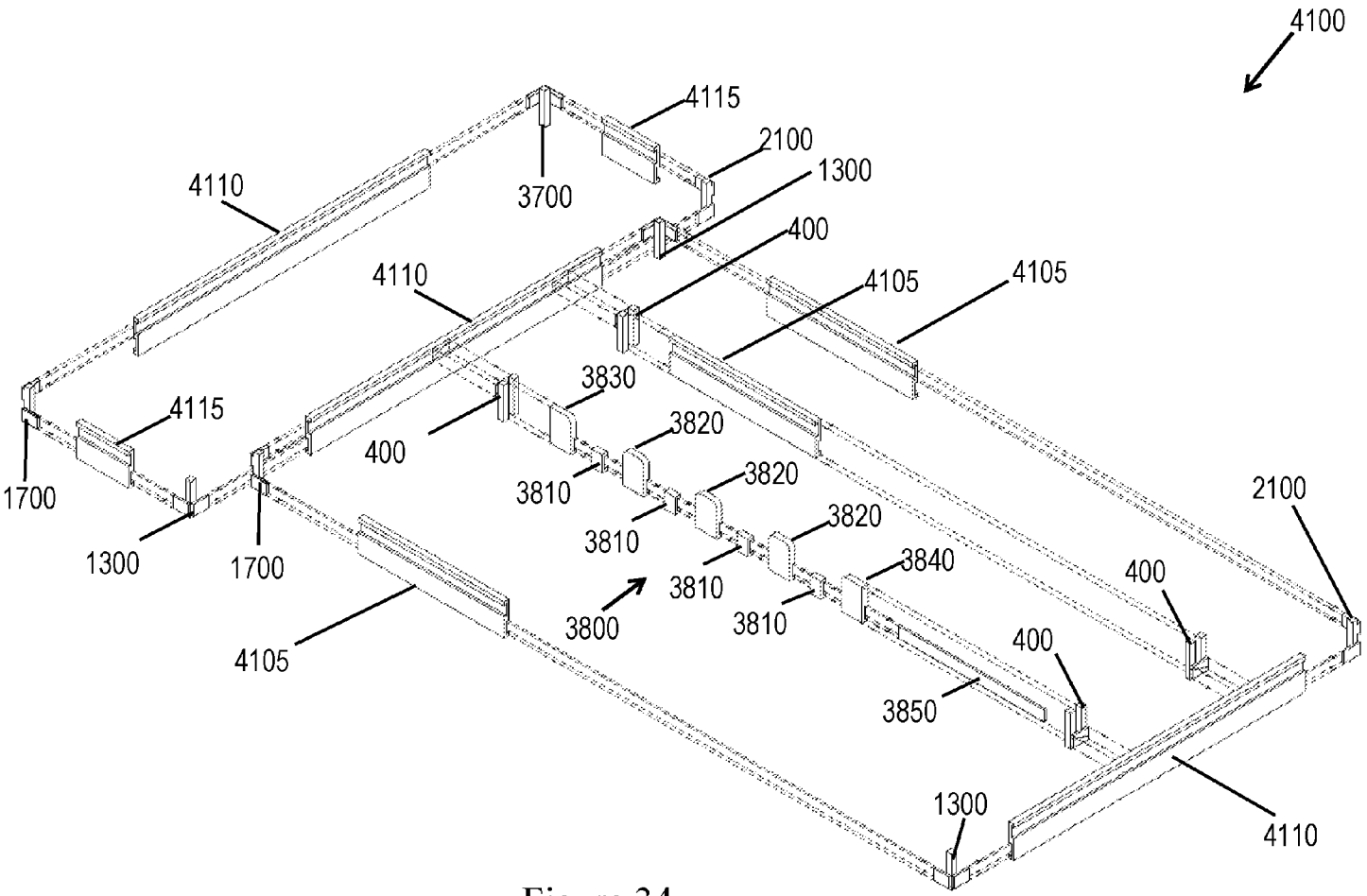
FIG. 34 is an illustration of an exploded view of one embodiment of a compartment divider assembly with an accessory holder assembly.

FIG. 34 is an illustration of an exploded view of one embodiment of a compartment divider assembly with an accessory holder assembly. As shown in FIG. 34, another embodiment of a compartment divider assembly 4100 with an accessory holder assembly 3800 may comprise: dividers 4105, 4110, 4115 corner couplers 1700, 2100, 1300 and divider support groove assemblies 400. FIG. 34 shows that the divider support groove assemblies 400 may be adapted to hold and secure the divider 4105 and accessory holder assembly 3800, which may be used to releasably hold and stack accessories such as tools and/or utensils.

Figure 35:
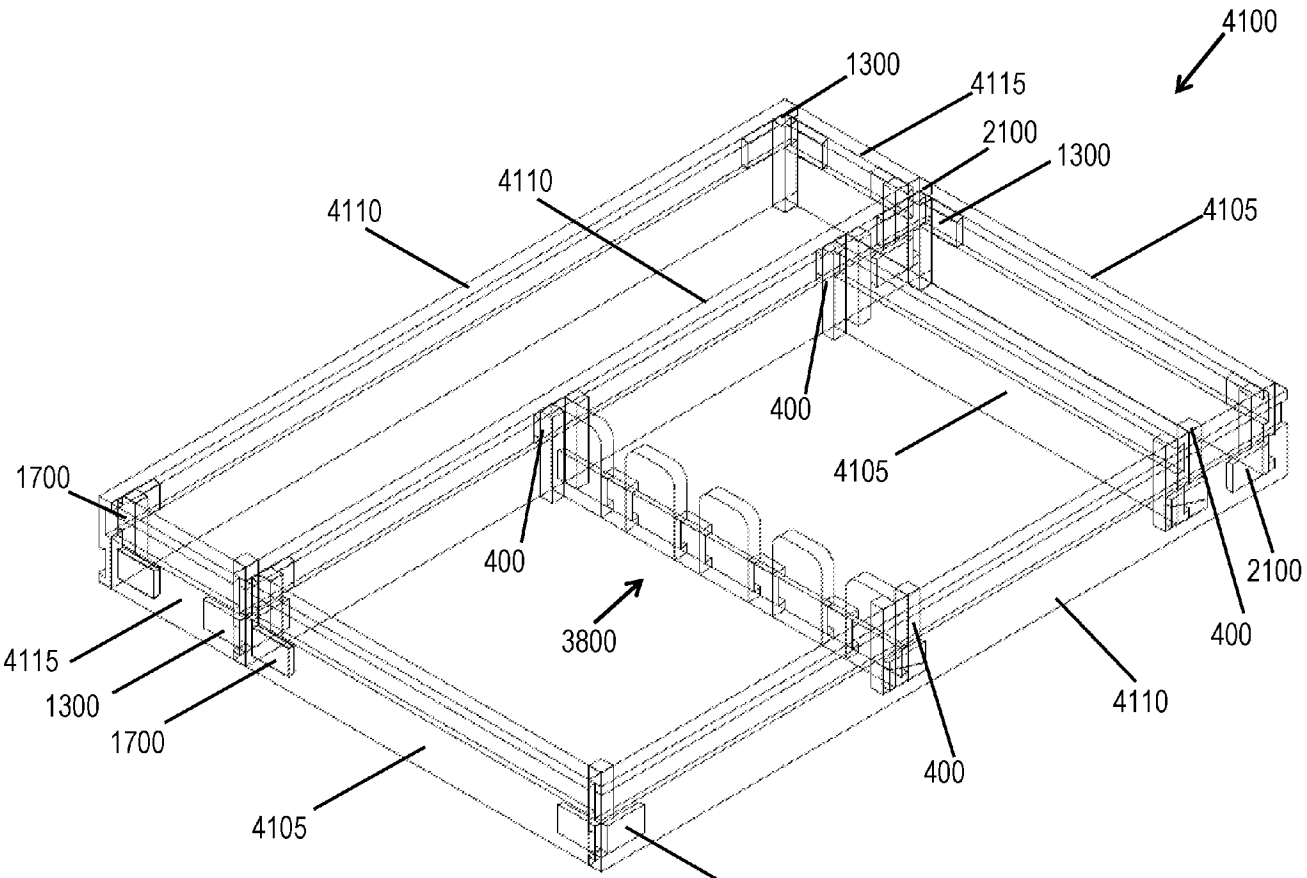
FIG. 35 is an illustration of an assembled view of one embodiment of a compartment divider assembly with an accessory holder assembly.

FIG. 35 is an illustration of an assembled view of one embodiment of a compartment divider assembly with an accessory holder assembly. As shown in FIG. 34, another embodiment of a compartment divider assembly 4100 with an accessory holder assembly 3800 may comprise: dividers 4105, 4110, 4115 corner couplers 1700, 2100, 1300 and divider support groove assemblies 400. FIG. 35 shows how the divider support groove assemblies 400 hold and secure the divider 4105 and accessory holder assembly 3800.

Figure 36:
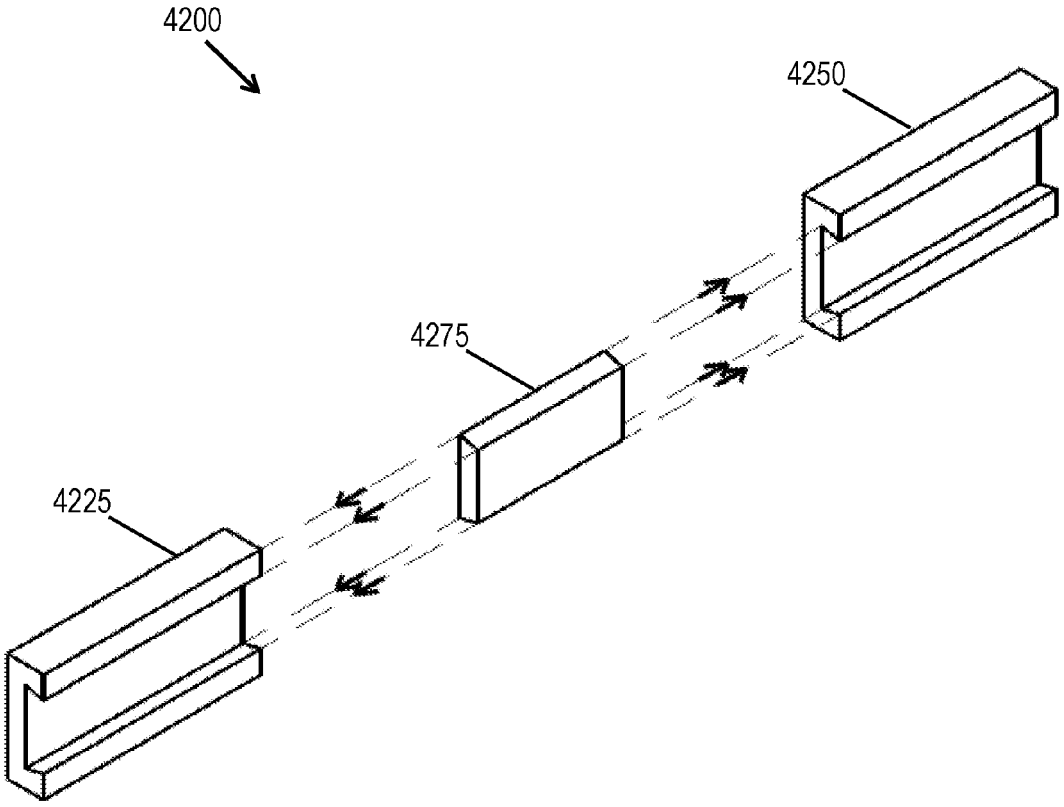
FIG. 36 is an illustration of an exploded view of another embodiment of a compartment divider assembly.

FIG. 36 is an illustration of an exploded view of another embodiment of a compartment divider assembly. As shown in FIG. 36, another embodiment of a compartment divider assembly 4200 may comprise: dividers 4225, 4250 and a coupler 4275. FIG. 36 shows that each of the dividers 4225, 4250 may comprise a dovetail groove with a single unit of height of measurement. FIG. 36 also shows that the dividers 4225, 4250 may couple with one another via coupler 4275. This may allow the dividers 4225, 4250 to align and/or couple with one another via the coupler 4275, which may intersect the dovetail grooves of both dividers 4225, 4250.

Figure 37:
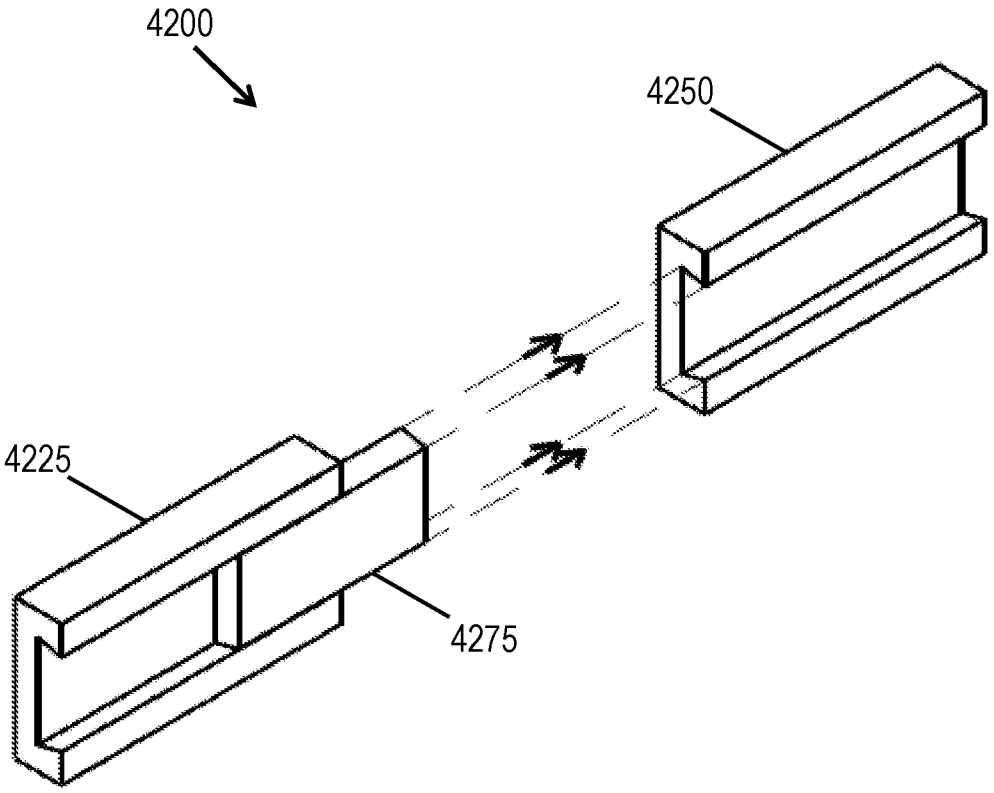
FIG. 37 is an illustration of a partial, assembled view of another embodiment of the compartment divider assembly.

FIG. 37 is an illustration of a partial, assembled view of another embodiment of the compartment divider assembly. As shown in FIG. 37, another embodiment of a compartment divider assembly 4200 may comprise: dividers 4225, 4250 and a coupler 4275. FIG. 37 shows that a first end portion of the coupler 4275 may be coupled to the dovetail groove of divider 4225. The second end portion of the coupler 4275 may be adapted to couple to the dovetail groove of divider 4250.

Figure 38:
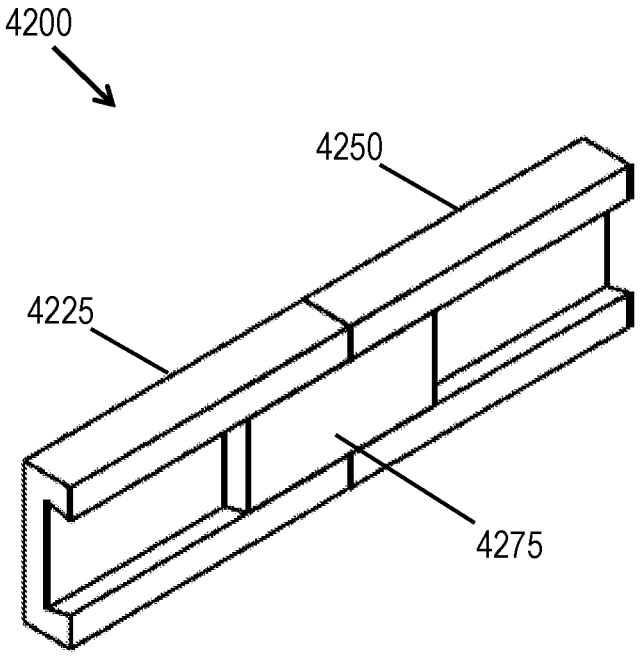
FIG. 38 is an illustration of an assembled view of another embodiment of the compartment divider assembly.

FIG. 38 is an illustration of an assembled view of another embodiment of the compartment divider assembly. As shown in FIG. 38, another embodiment of a compartment divider assembly 4200 may comprise: dividers 4225, 4250 and a coupler 4275. FIG. 38 shows that the coupler 4275 may be coupled to the dovetail grooves of both dividers 4225, 4250.

In various embodiments, one or more dividers of the compartment divider assemblies may include a two unit or double unit height of measurement with a single dovetail groove on each side of the divider. In these embodiments, the placement of the dovetail grooves may be disposed or arranged in an alternating pattern. This alternating pattern of the dovetail groove may be consistent or uniform regardless of the height of the divider and may be located near the bottom portion of the divider. For example, as shown in the embodiments in FIGS. 31-35, some of the dividers of the dovetail grooves may be positioned in a consistent and alternating pattern near the bottom portion of the dividers and may be approximately at the same height. In this manner, these compartment divider assemblies may form taller assemblies while utilizing a consistent dovetail groove pattern for ease of coupling.

In various embodiments, the compartment divider assemblies disclosed in the foregoing description may also utilize interference fit (e.g., press fit, friction fit) in areas where portions of the components contact, mate, or engage with one another, such as the corner and coupling connections. Interference fit may achieve fastening between two parts by utilizing friction after the parts are pushed together, rather than by any other means of fastening. These embodiments of the compartment divider assemblies may utilize various materials to achieve interference fit or friction fit such as wood, polymers (e.g., plastic), or any man-made and/or non-manmade materials. Importantly, in addition to friction, various embodiments may utilize additional features such as dimples, graduating friction fits, set screws, adhesives, springs or other technology in order to help fasten the components of the compartment divider assemblies.

The foregoing description of the specific embodiments will so fully reveal the general nature of the invention that others can, by applying current knowledge, readily modify and/or adapt for various applications such specific embodiments without departing from the generic concept, and, therefore, such adaptations and modifications should and are intended to be comprehended within the meaning and range of equivalents of the disclosed embodiments. It is to be understood that the phraseology or terminology employed herein is for the purpose of description and not of limitation. Therefore, while the embodiments of the invention have been described in terms of preferred embodiments, those skilled in the art will recognize that the embodiments of the invention can be practiced with modification within the spirit and scope of the appended claims.

Unless otherwise stated, all measurements, values, ratings, positions, magnitudes, sizes, locations, and other specifications which are set forth in this specification, including in the claims which follow, are approximate, not exact. They are intended to have a reasonable range which is consistent with the functions to which they relate and with what is customary in the art to which they pertain.

The foregoing description of the embodiments has been presented for the purposes of illustration and description. While multiple embodiments are disclosed, still other embodiments will become apparent to those skilled in the art from the above detailed description. As will be realized, these embodiments are capable of modifications in various obvious aspects, all without departing from the spirit and scope of the protection. Accordingly, the detailed description is to be regarded as illustrative in nature and not restrictive. Also, although not explicitly recited, one or more embodiments may be practiced in combination or conjunction with one another. Furthermore, the reference or non-reference to a particular embodiment shall not be interpreted to limit the scope of protection. It is intended that these embodiments not be limited by this detailed description, but by the claims and the equivalents to the claims that are appended hereto.

Except as stated immediately above, nothing which has been stated or illustrated is intended or should be interpreted to cause a dedication of any component, step, feature, object, benefit, advantage, or equivalent to the public, regardless of whether it is or is not recited in the claims.

What is claimed is:

1. A compartment divider assembly, comprising:

a first divider having at least one dovetail groove traversing along a longitudinal axis; and a divider support groove assembly, comprising: a first support groove and a second support groove;

wherein said first support groove comprises: a first groove portion and a first dovetail portion;

wherein said second support groove comprises: a second groove portion and a second dovetail portion;

wherein said first dovetail portion has a first planar face sloping outwardly at a first dovetail angle and a second planar face sloping at a sliding angle away from said first planar face;

wherein said second dovetail portion has a third planar face sloping outwardly at a second dovetail angle and a fourth planar face sloping at said sliding angle away from said third planar face;

wherein said first dovetail portion and said second dovetail portion form a first male dovetail when said second planar face contacts said fourth planar face;

wherein said first male dovetail is adapted to slideably engage with said at least one dovetail groove;

wherein said second planar face of said first dovetail portion is adapted to contact and slide with said fourth planar face of said second dovetail portion at said sliding angle in a back and forth manner, such that said divider support groove assembly comprises at least two configurations: a lock configuration and a release configuration;

wherein said lock configuration occurs when said first planar face of said first dovetail portion contacts and engages a first inner side of said at least one dovetail groove and when said third planar face of said second dovetail portion contacts and engages with a second inner side of said at least one dovetail groove while said second planar face and said fourth planar face are in contact with each other;

wherein said release configuration occurs when said first groove portion and said second groove portion are slid proximally towards each other and said second planar face and said fourth planar face are in contact with each other, such that said first planar face of said first dovetail portion is no longer in contact with said first inner side of said at least one dovetail groove and when said third planar face of said second dovetail portion is no longer in contact with said second inner side of said at least one dovetail groove;

wherein said lock configuration creates a gap between said first groove portion and said second groove portion; and wherein said gap is fitted to engage with an end of a second divider.

2. The compartment divider assembly of claim 1, wherein when said divider support groove assembly is in said release configuration, said divider support groove assembly may be removed from said at least one dovetail groove.

3. The compartment divider assembly of claim 2, further comprising a corner coupler;

wherein said corner coupler comprises at least a second male dovetail and a third male dovetail;

wherein said second male dovetail and said third male dovetail are adapted to slideably engage with said at least one dovetail groove; and wherein said second male dovetail is disposed at an angle substantially perpendicular to said third male dovetail.

4. The compartment divider assembly of claim 3, further comprising a third divider;

wherein said third divider comprises at least one dovetail groove traversing along a longitudinal axis; and wherein said second male dovetail and said third male dovetail are adapted to slideably engage with said at least one dovetail groove of said third divider.

5. The compartment divider assembly of claim 3, wherein said second male dovetail of said corner coupler is positioned at substantially a same height of said third male dovetail.

6. The compartment divider assembly of claim 3, wherein said second male dovetail of said corner coupler is positioned at a height different from said third male dovetail.

7. The compartment divider assembly of claim 2, further comprising an accessory holder assembly;

wherein said accessory holder assembly comprises at least one small support piece, at least one large support piece, and a fourth male dovetail;

wherein said at least one small support piece and said at least one large support piece each comprise a dovetail groove; and wherein said fourth male dovetail is adapted to slideably engage with said dovetail grooves of said at least one small support piece and said at least one large support piece, such that said at least one small support piece and said at least one large support piece form a recess adapted to receive an accessory.

8. The compartment divider assembly of claim 7, wherein an end of said accessory holder assembly is dimensioned to engage and fit within said gap of said first groove portion and said second groove portion of said divider support groove assembly.

9. The compartment divider assembly of claim 2, wherein said first divider comprises at least two dovetail grooves traversing along said longitudinal axis; and wherein said at least two dovetail grooves are a first divider dovetail groove and a second divider dovetail groove;

wherein said first divider dovetail groove is located at a first side of said first divider;

wherein said second divider dovetail groove is located at a second side of said first divider; and wherein said first divider dovetail groove and said second divider dovetail groove are disposed at different heights.

10. The compartment divider assembly of claim 2, wherein said first divider comprises at least three dovetail grooves traversing along said longitudinal axis; and wherein said at least three dovetail grooves are a first divider dovetail groove, a second divider dovetail groove, and a third divider dovetail groove.

11. The compartment divider assembly of claim 10, wherein said first divider dovetail groove and said third divider dovetail groove are located at a first side of said first divider; and wherein said second divider dovetail groove is positioned at a second side of said first divider.

12. A compartment divider assembly, comprising:

a first divider having at least one dovetail groove traversing along a longitudinal axis;

a second divider; and a divider support groove assembly, comprising: a first support groove and a second support groove;

wherein said first support groove comprises: a first groove portion and a first dovetail portion;

wherein said second support groove comprises: a second groove portion and a second dovetail portion;

wherein said first dovetail portion has a first planar face traversing along said longitudinal axis and sloping outwardly at a first dovetail angle and a second planar face sloping at a sliding angle away from said first planar face;

wherein said second dovetail portion has a third planar face traversing along said longitudinal axis and sloping outwardly at a second dovetail angle and a fourth planar face sloping at said sliding angle away from said third planar face;

wherein said first dovetail portion and said second dovetail portion form a first male dovetail when said second planar face contacts said fourth planar face;

wherein said first male dovetail is adapted to slideably engage with said at least one dovetail groove;

wherein said second planar face of said first dovetail portion is adapted to contact and slide with said fourth planar face of said second dovetail portion at said sliding angle in a back and forth manner, such that said divider support groove assembly comprises at least two configurations: a lock configuration and a release configuration;

wherein said lock configuration occurs when said first planar face of said first dovetail portion contacts and engages a first inner side of said at least one dovetail groove and when said third planar face of said second dovetail portion contacts and engages with a second inner side of said at least one dovetail groove while said second planar face and said fourth planar face are in contact each other;

wherein said release configuration occurs when said first groove portion and said second groove portion are slid proximally towards each other and said second planar face and said fourth planar face are in contact with each other, such that said first planar face of said first dovetail portion is no longer in contact with said first inner side of said at least one dovetail groove and when said third planar face of said second dovetail portion is no longer in contact with said second inner side of said at least one dovetail groove;

wherein said lock configuration creates a gap between said first groove portion and said second groove portion;

wherein said gap is fitted to engage with an end of said second divider; and wherein when said divider support groove assembly is in said release configuration, said divider support groove assembly may be removed from said at least one dovetail groove.

13. The compartment divider assembly of claim 12, further comprising a corner coupler;

wherein said corner coupler comprises at least a second male dovetail and a third male dovetail;

wherein said second male dovetail and said third male dovetail are adapted to slideably engage with said at least one dovetail groove; and wherein said second male dovetail is disposed at an angle substantially perpendicular to said third male dovetail.

14. The compartment divider assembly of claim 13, further comprising a third divider;

wherein said third divider comprises at least one dovetail groove traversing along a longitudinal axis; and wherein said second male dovetail and said third male dovetail are adapted to slideably engage with said at least one dovetail groove of said third divider.

15. The compartment divider assembly of claim 13, wherein said second male dovetail of said corner coupler is positioned at substantially a same height of said third male dovetail.

16. The compartment divider assembly of claim 13, wherein said second male dovetail of said corner coupler is positioned at a height different from said third male dovetail.

17. The compartment divider assembly of claim 12, further comprising an accessory holder assembly;

wherein said accessory holder assembly comprises at least one small support piece, at least one large support piece, and a fourth male dovetail;

wherein said at least one small support piece and said at least one large support piece each comprise a dovetail groove; and wherein said fourth male dovetail is adapted to slideably engage with said dovetail grooves of said at least one small support piece and said at least one large support piece, such that said at least one small support piece and said at least one large support piece form a recess adapted to receive an accessory.

18. The compartment divider assembly of claim 17, wherein an end of said accessory holder assembly is dimensioned to engage and fit within said gap of said first groove portion and said second groove portion of said divider support groove assembly.

19. The compartment divider assembly of claim 12, wherein said first divider comprises at least two dovetail grooves traversing along said longitudinal axis; and wherein said at least two dovetail grooves are a first divider dovetail groove and a second divider dovetail groove;

wherein said first divider dovetail groove is located at a first side of said first divider;

wherein said second divider dovetail groove is located at a second side of said first divider; and wherein said first divider dovetail groove and said second divider dovetail groove are disposed at different heights.

20. The compartment divider assembly of claim 12, wherein said first divider comprises at least three dovetail grooves traversing along said longitudinal axis; and wherein said at least three dovetail grooves are a first divider dovetail groove, a second divider dovetail groove, and a third divider dovetail groove.

21. The compartment divider assembly of claim 20, wherein said first divider dovetail groove and said third divider dovetail groove are located at a first side of said first divider; and wherein said second divider dovetail groove is positioned at a second side of said first divider, such that said first divider dovetail groove, said second divider dovetail groove, and said third divider dovetail groove are disposed at opposite sides of said first divider in an alternating fashion.

* * * * *